US012296224B2

(12) United States Patent
Woo

(10) Patent No.: US 12,296,224 B2
(45) Date of Patent: May 13, 2025

(54) EQUIPMENT FOR STRENGTHENING SWING MOTION ABILITY

(71) Applicant: Sung Taek Woo, Gangwon-do (KR)

(72) Inventor: Sung Taek Woo, Gangwon-do (KR)

( * ) Notice: Subject to any disclaimer, the term of this patent is extended or adjusted under 35 U.S.C. 154(b) by 142 days.

(21) Appl. No.: 17/997,238

(22) PCT Filed: Apr. 30, 2021

(86) PCT No.: PCT/KR2021/005516
§ 371 (c)(1),
(2) Date: Oct. 26, 2022

(87) PCT Pub. No.: WO2021/230545
PCT Pub. Date: Nov. 18, 2021

(65) Prior Publication Data

US 2023/0398405 A1 Dec. 14, 2023

(30) Foreign Application Priority Data

May 14, 2020 (KR) ..... 10-2020-0057737

(51) Int. Cl.
*A63B 23/12* (2006.01)
*A63B 21/055* (2006.01)
*A63B 23/04* (2006.01)

(52) U.S. Cl.
CPC ..... *A63B 23/12* (2013.01); *A63B 21/0552* (2013.01); *A63B 23/04* (2013.01); *A63B 2209/08* (2013.01)

(58) Field of Classification Search
CPC ..... A63B 23/12; A63B 21/0552; A63B 23/04; A63B 2209/08; A63B 2209/14;
(Continued)

(56) References Cited

U.S. PATENT DOCUMENTS 728,206 A * 5/1903 Crafts ..... A44B 11/28 24/196
2,704,871 A * 3/1955 Bender ..... A44B 11/223 24/710.3

(Continued)

FOREIGN PATENT DOCUMENTS

JP 6-26948 U 4/1994
JP 3195971 U 1/2015

(Continued)

OTHER PUBLICATIONS

International Search Report of PCT/KR2021/005516, Aug. 12, 2021, 4 pages.

(Continued)

*Primary Examiner* — Garrett K Atkinson
(74) *Attorney, Agent, or Firm* — Womble Bond Dickinson (US) LLP

(57) ABSTRACT

Equipment for strengthening swing motion ability of the present disclosure includes: a shoulder holder formed in a closed loop shape to be held on a right shoulder or a left shoulder; a body holder extending a predetermined length from the shoulder holder to be held on a back toward a shoulder opposite to the shoulder with the shoulder holder held thereon; a pelvis holder extending a predetermined length from the body holder to be held on a pelvis positioned opposite to the shoulder with the shoulder holder held thereon; an extension extending a predetermined length from the pelvis holder toward the shoulder with the shoulder holder held thereon; and an elasticity applier having a first end connected to the extension and a second end configured to be fixed to a predetermined position.

15 Claims, 28 Drawing Sheets

(58) Field of Classification Search
CPC ..... A63B 2225/09; A63B 21/4009; A63B 21/4025; A63B 69/3623; A63B 2102/02; A63B 2102/18; A63B 2102/32; A63B 69/00; A63B 69/0059; A63B 21/055; A63B 21/00069; A63B 21/0557; A63B 21/065; A63B 21/4011; A63B 21/4039; A63B 21/4017
See application file for complete search history.

(56) References Cited

U.S. PATENT DOCUMENTS 3,069,169 A * 12/1962 Topping ..... A63B 69/0059 473/212
3,819,177 A * 6/1974 Spiro ..... A63B 21/00043 482/122
3,937,465 A * 2/1976 Roland ..... A63B 69/38 473/464
4,134,589 A * 1/1979 Arena ..... A63B 69/3608 473/409
4,506,883 A * 3/1985 Rathbun ..... A63B 23/03575 482/13
4,570,929 A * 2/1986 Shoemaker ..... A63B 21/0552 112/475.08
4,815,731 A * 3/1989 Suarez ..... A63B 21/055 482/126
4,862,563 A * 9/1989 Flynn ..... F16B 2/08 24/442
5,295,949 A * 3/1994 Hathaway ..... A63B 23/025 602/14
D353,172 S * 12/1994 Gaut ..... D30/152
5,433,688 A * 7/1995 Davies ..... A63B 21/151 482/126
5,451,060 A * 9/1995 Dalbo ..... A63B 69/0059 473/215
5,795,238 A * 8/1998 Nicholson ..... A63B 69/36 473/214
5,951,443 A * 9/1999 Askins ..... A63B 23/047 482/148
6,027,413 A * 2/2000 Smith ..... A63B 21/0552 473/215
6,196,931 B1 * 3/2001 Wilt ..... A63B 69/3608 473/212
6,458,036 B1 * 10/2002 Gutierrez ..... A63B 23/03508 473/207
6,554,747 B1 * 4/2003 Rempe ..... A63B 21/4011 482/69
6,755,755 B2 * 6/2004 Wah Loh ..... A63B 21/4009 119/770
6,832,960 B2 * 12/2004 Thony ..... A63B 69/0059 473/277
10,029,136 B2 * 7/2018 Aldridge ..... A63B 21/00185
10,226,666 B2 * 3/2019 Fay ..... A63B 21/4017
10,517,339 B1 * 12/2019 Baxter ..... A41D 20/00
10,737,136 B2 * 8/2020 Burkinshaw ..... A63B 21/1636
2015/0360076 A1 * 12/2015 Celebrini ..... A63B 21/0442 482/121
2016/0236026 A1 * 8/2016 Hauptmann ..... A63B 21/00069
2016/0324233 A1 * 11/2016 Voyvodic ..... A63B 21/00076
2017/0128776 A1 * 5/2017 Fay ..... A63B 60/32
2018/0264307 A1 * 9/2018 Wallander ..... A63B 21/4011
2018/0304134 A1 * 10/2018 Parque ..... A63B 21/4013
2020/0376342 A1 * 12/2020 Mumford ..... A63B 29/02
2021/0220693 A1 * 7/2021 DeKens ..... A63B 23/0238
2022/0233937 A1 * 7/2022 Lee ..... A63B 69/0059

FOREIGN PATENT DOCUMENTS

KR 10-0793442 B1 1/2008
KR 10-2018-0070705 A 6/2018

OTHER PUBLICATIONS

Tennis Swing Exerciser, Elastic Strength Exercise, Training Band Exerciser: Apple Tree Market, 4 pages https://m.smartstore.naver.com/appletreemarket/products/4867611358?NaPm=ct%3Dk93mm8wo%7Cci%3De0480b4bf152a64df5d344b809cb3c66db69acc7%7Ctr%3Dslct%7Csn%3D1132820%7Chk%3D01b32c88592b36b850826679f0944f2dee4a86e5.

* cited by examiner

【FIG. 1】
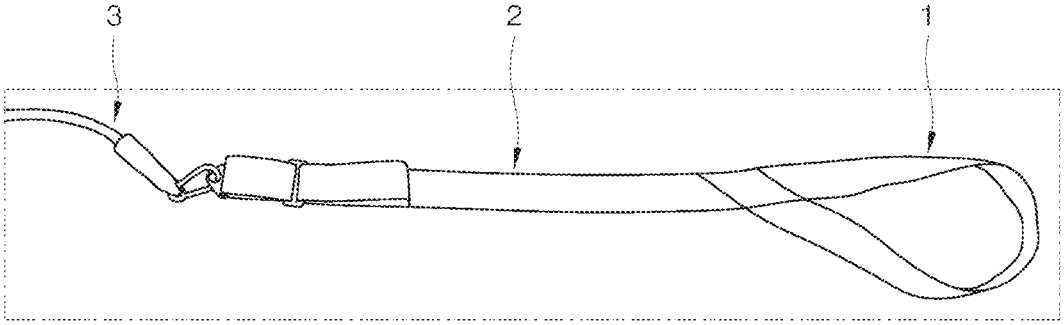
【FIG. 2】
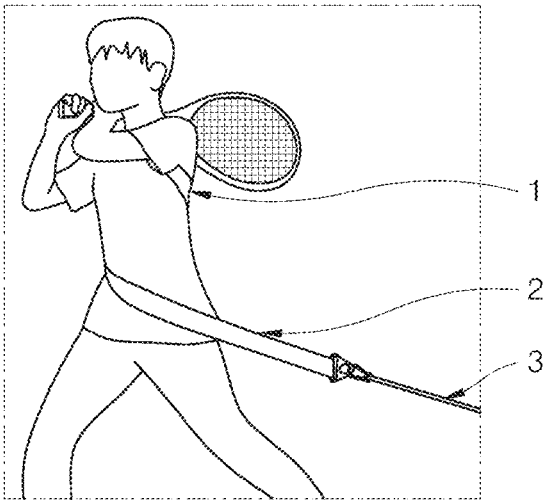

【FIG. 3】
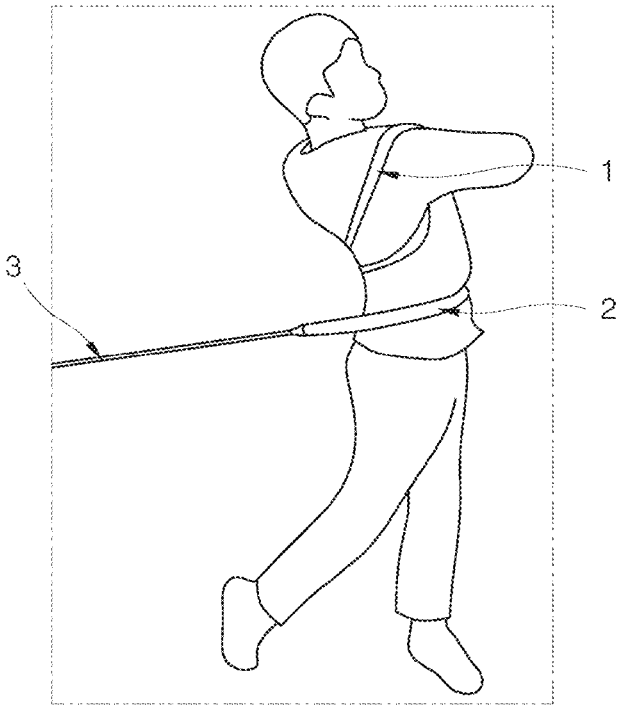
【FIG. 4】
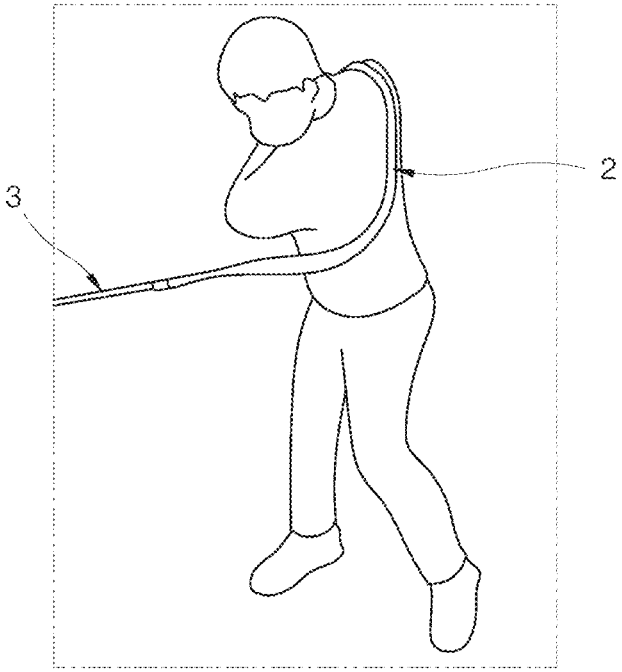

【FIG. 5】
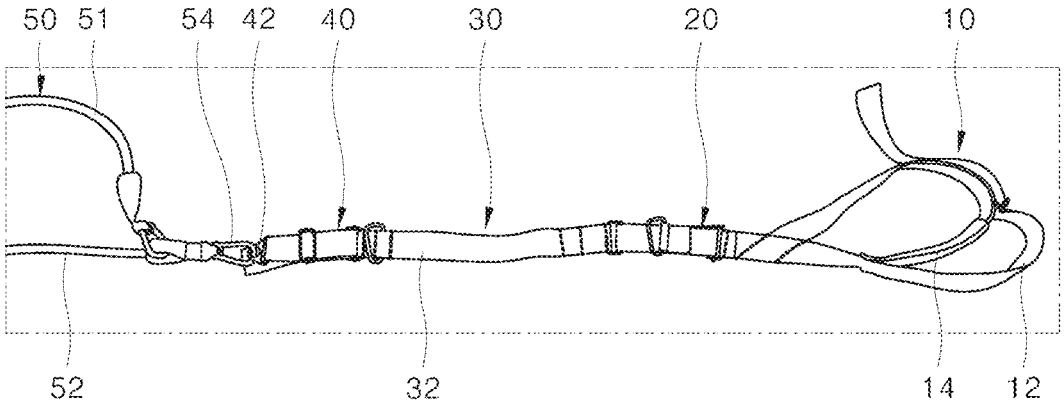

【FIG. 6】
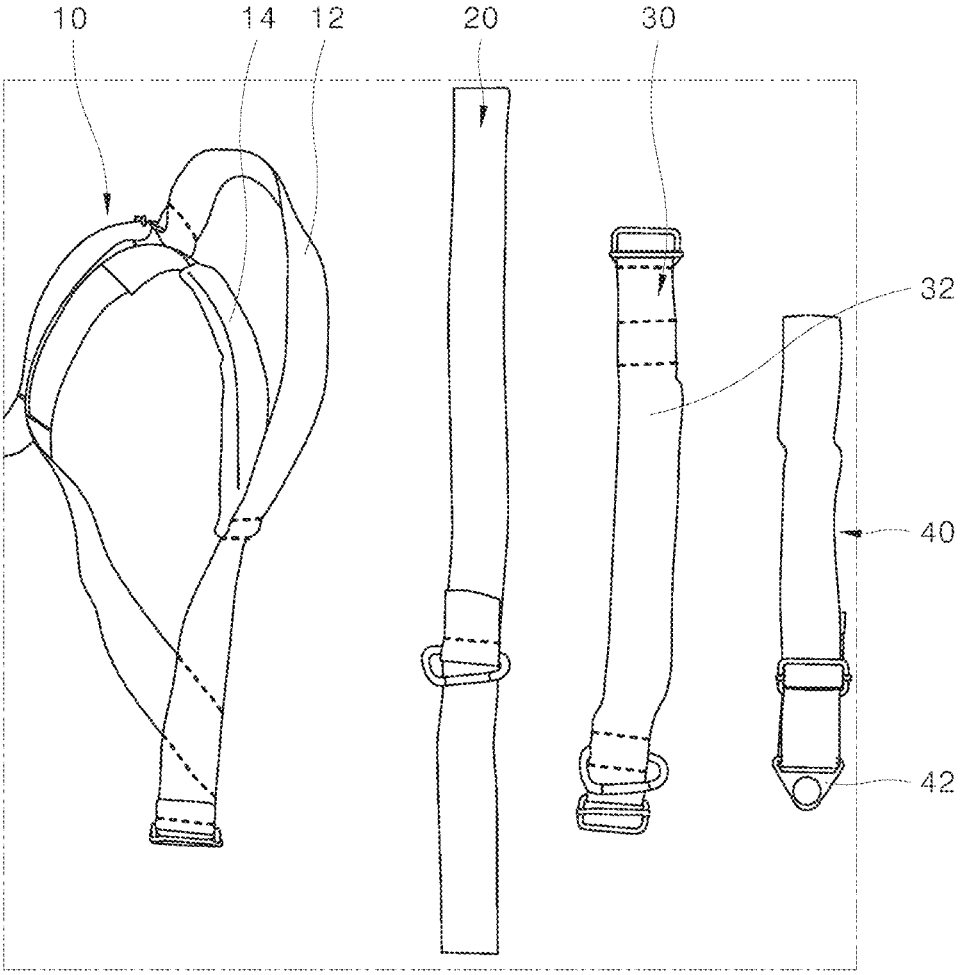

【FIG. 7】
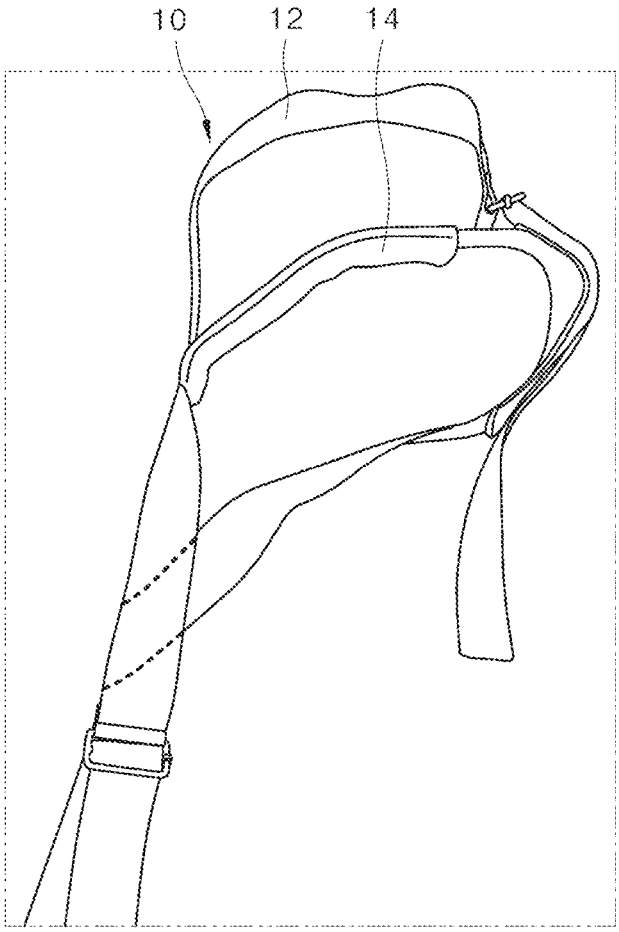

【FIG. 8】
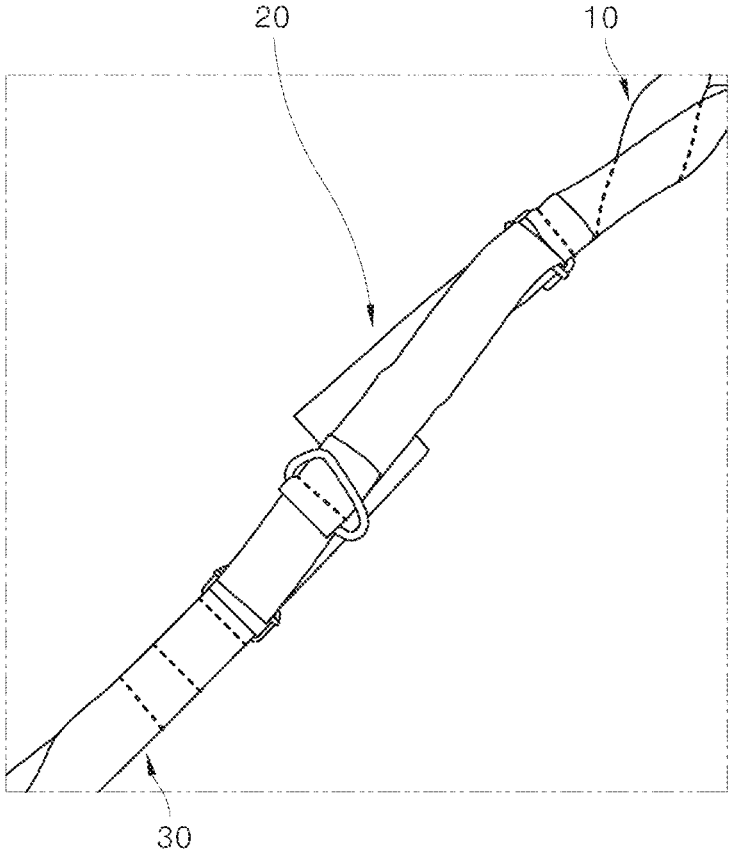

【FIG. 9】
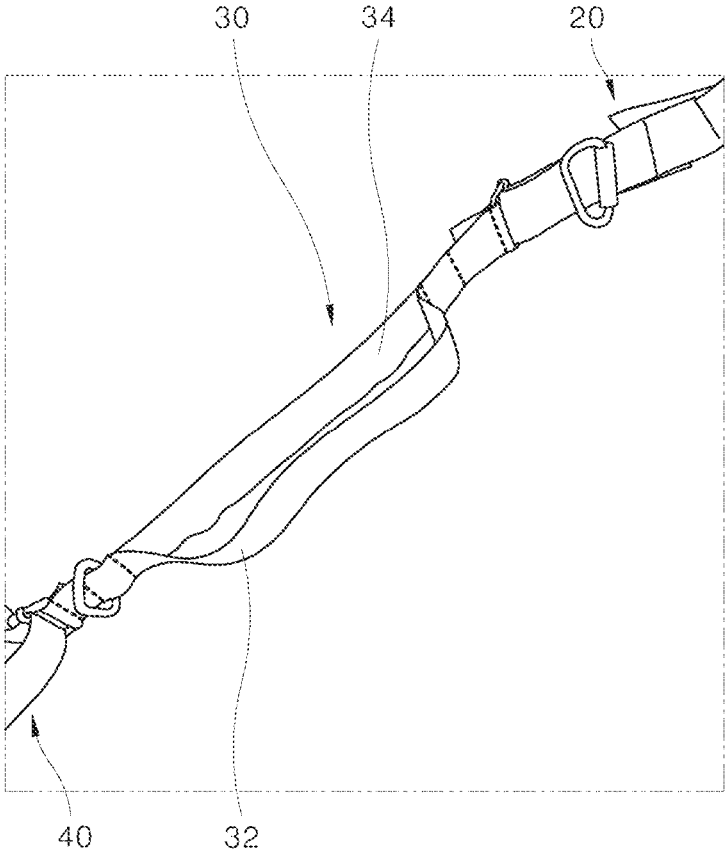

【FIG. 10】
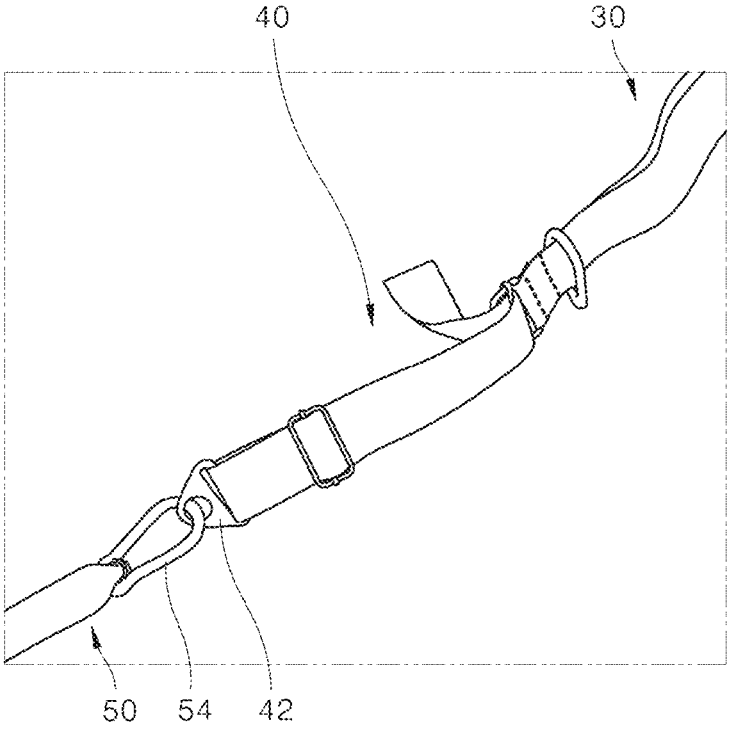
【FIG. 11】
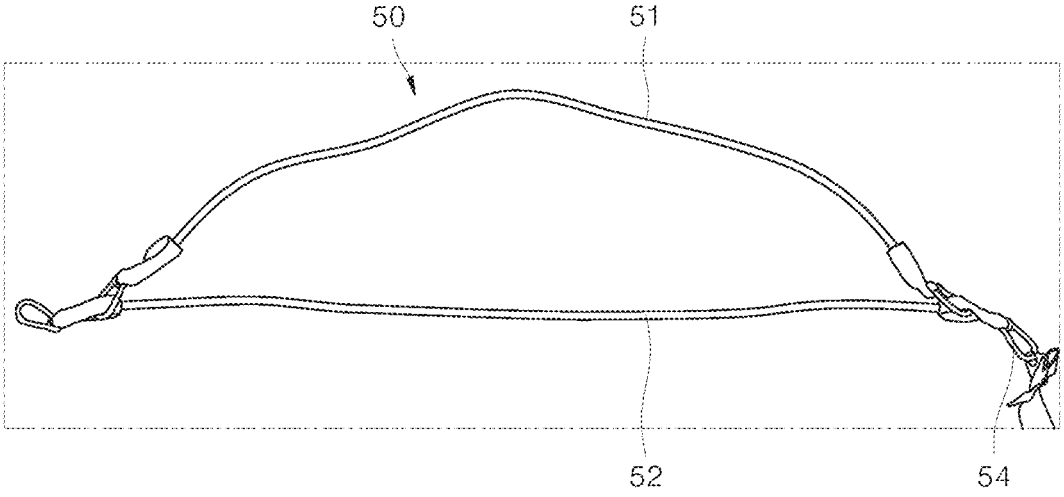

【FIG. 12】
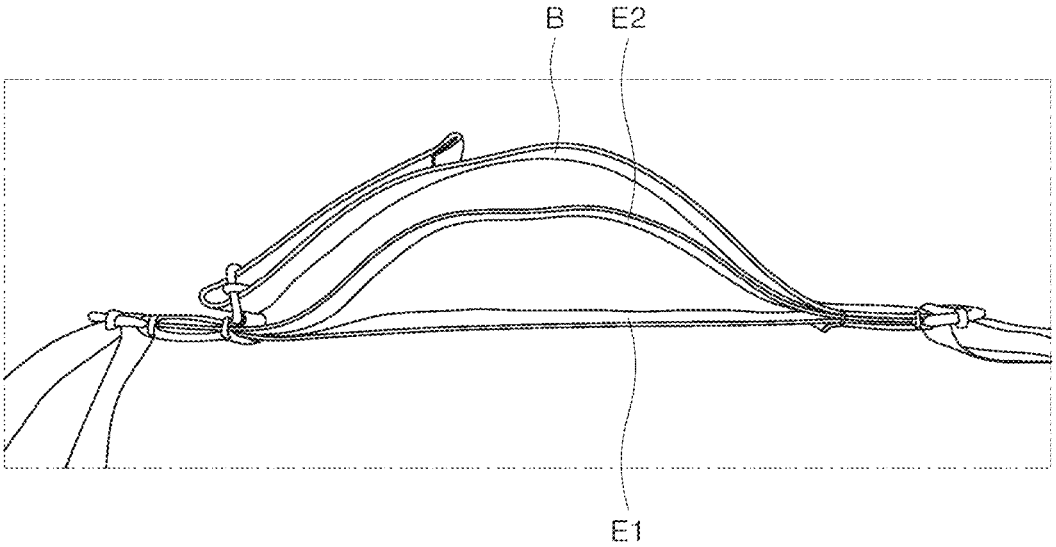
【FIG. 13】
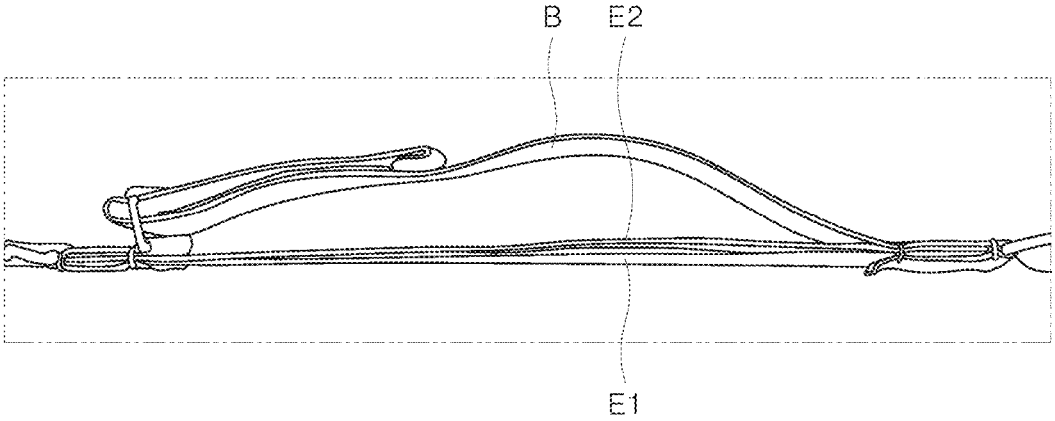
【FIG. 14】
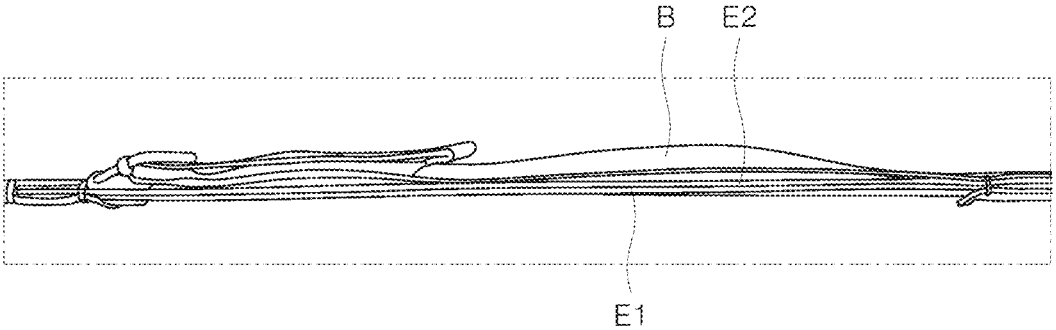

【FIG. 15】
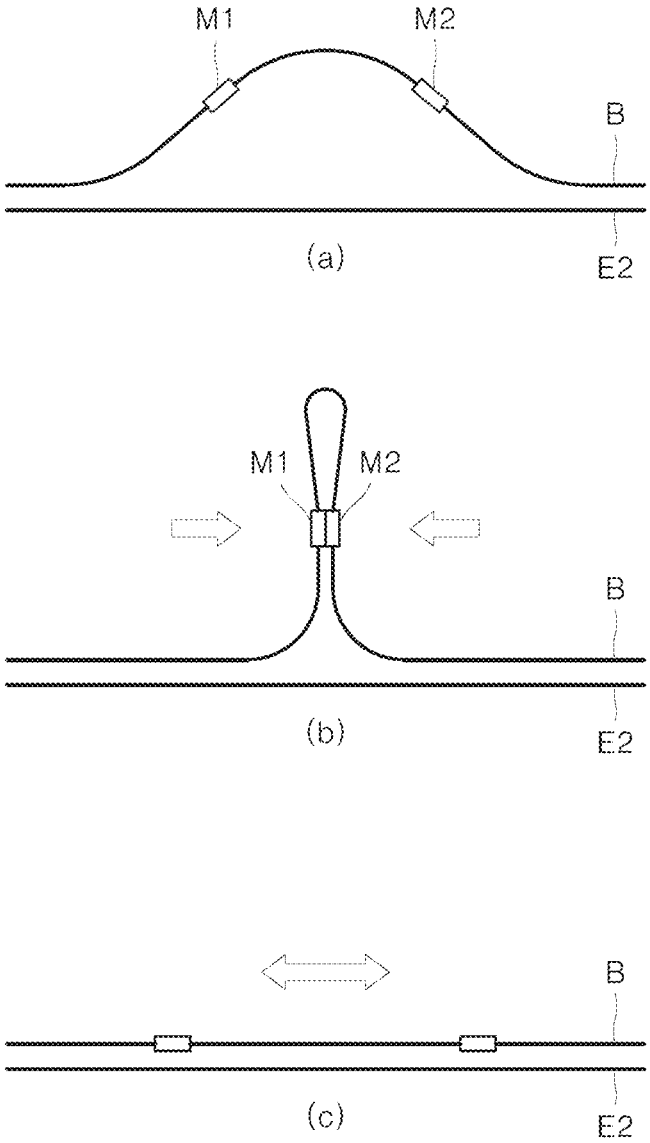

【FIG. 16】
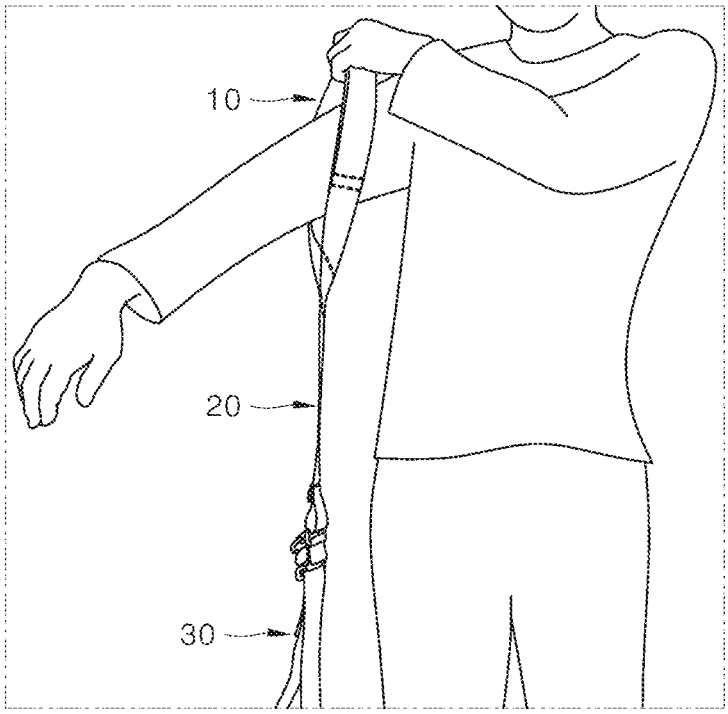

【FIG. 17】
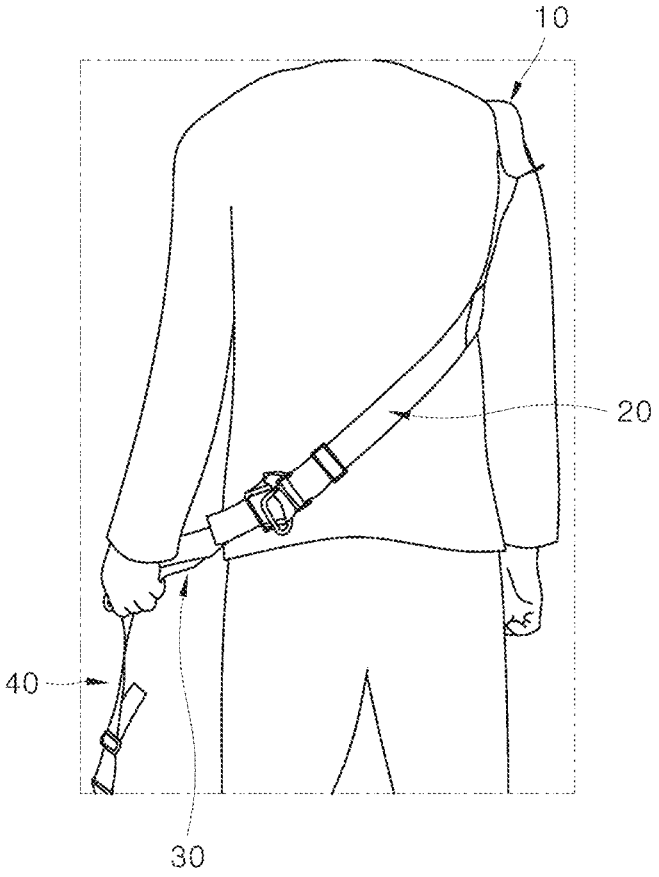

【FIG. 18】
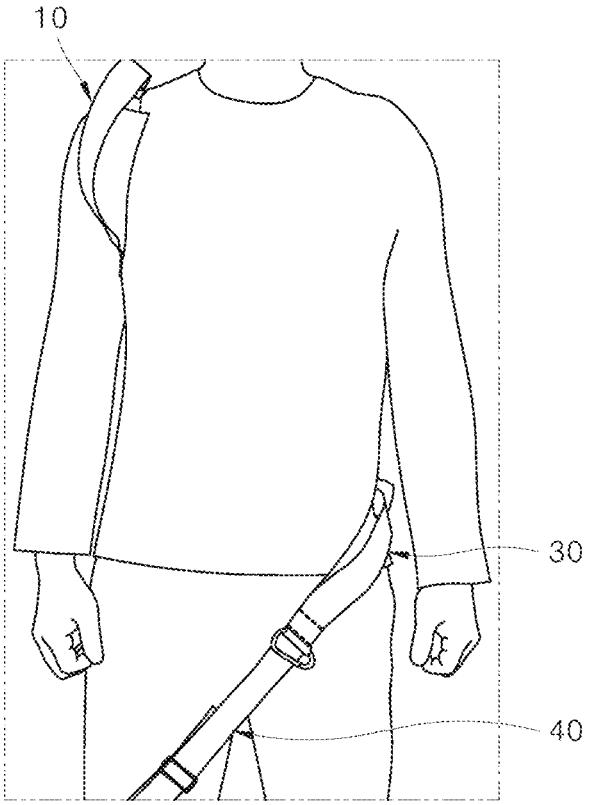

【FIG. 19】
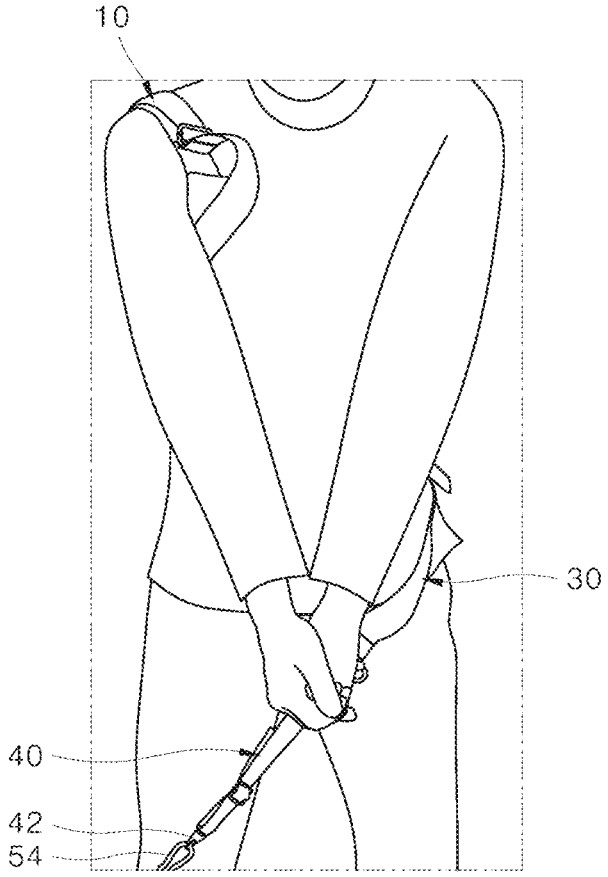

【FIG. 20】
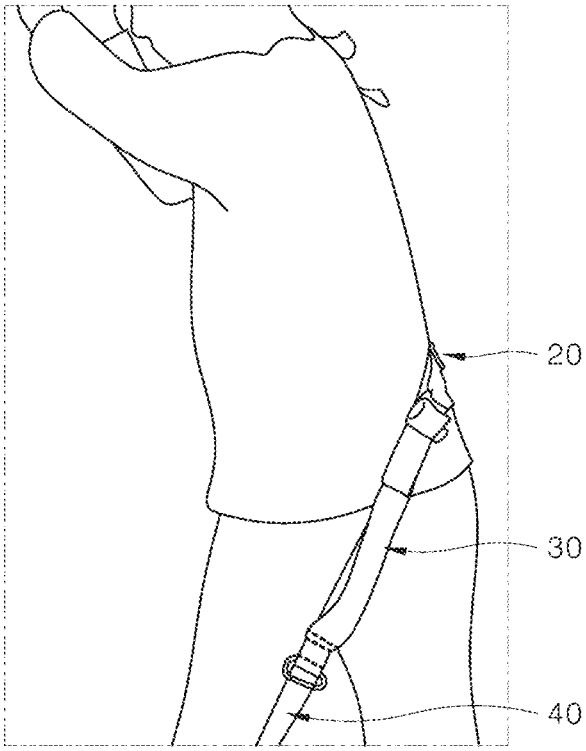

【FIG. 21】
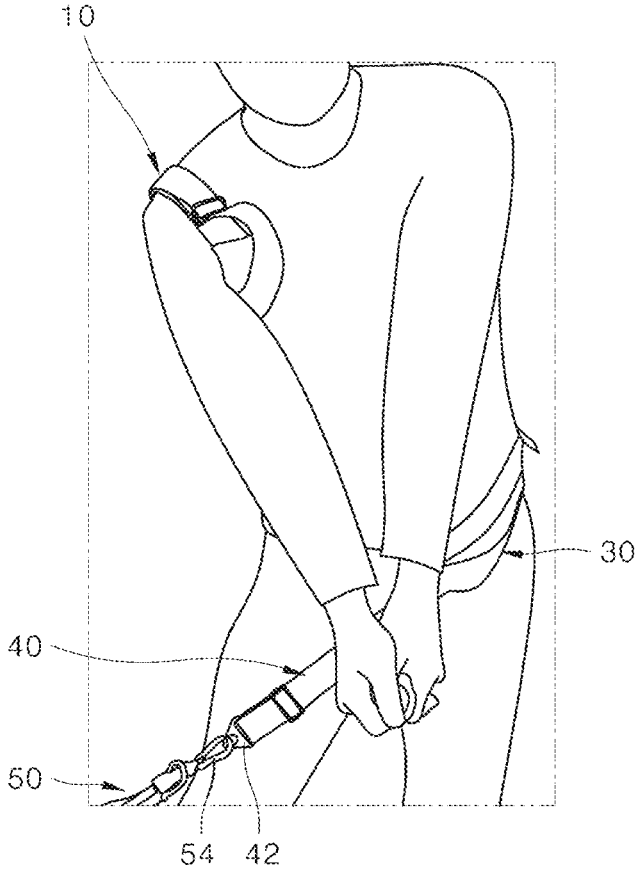

【FIG. 22】
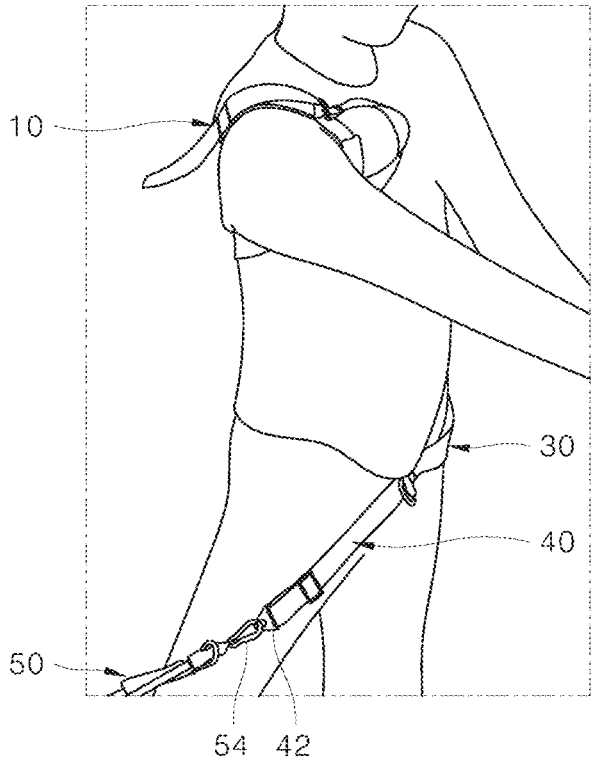

【FIG. 23】
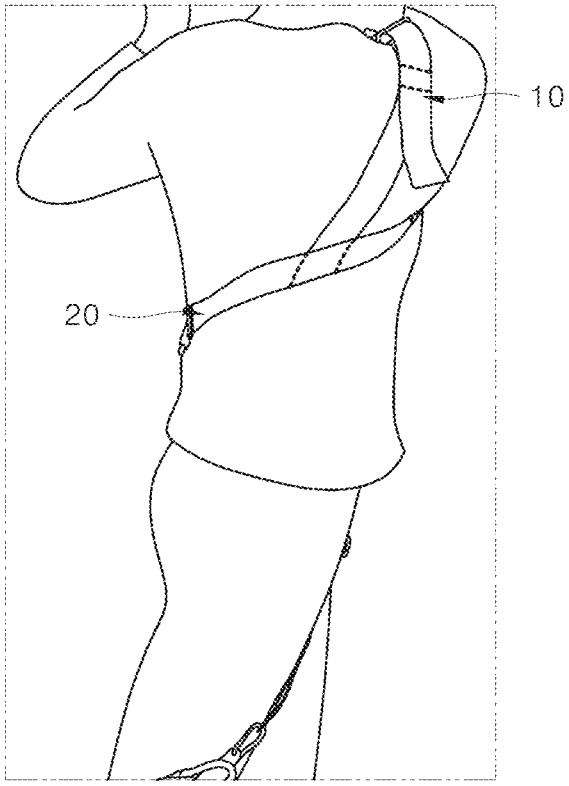
【FIG. 24】
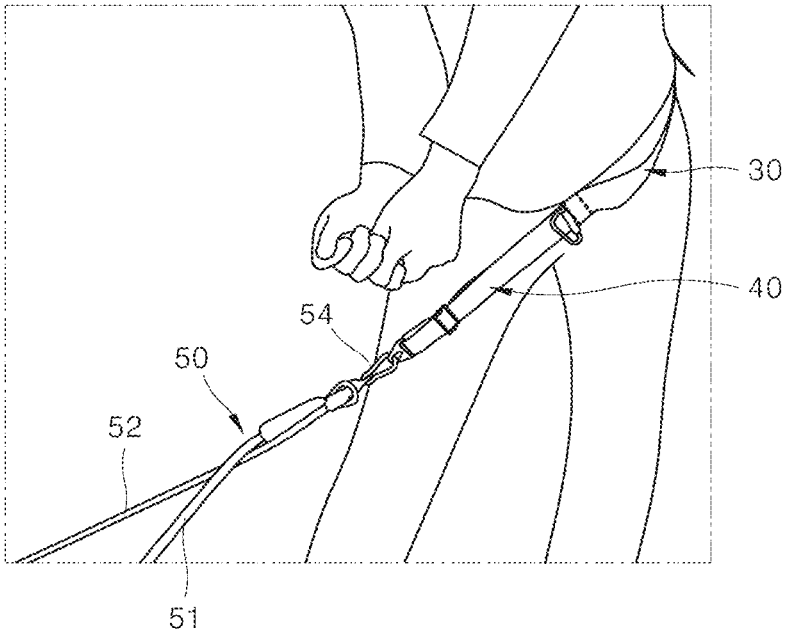

【FIG. 25】
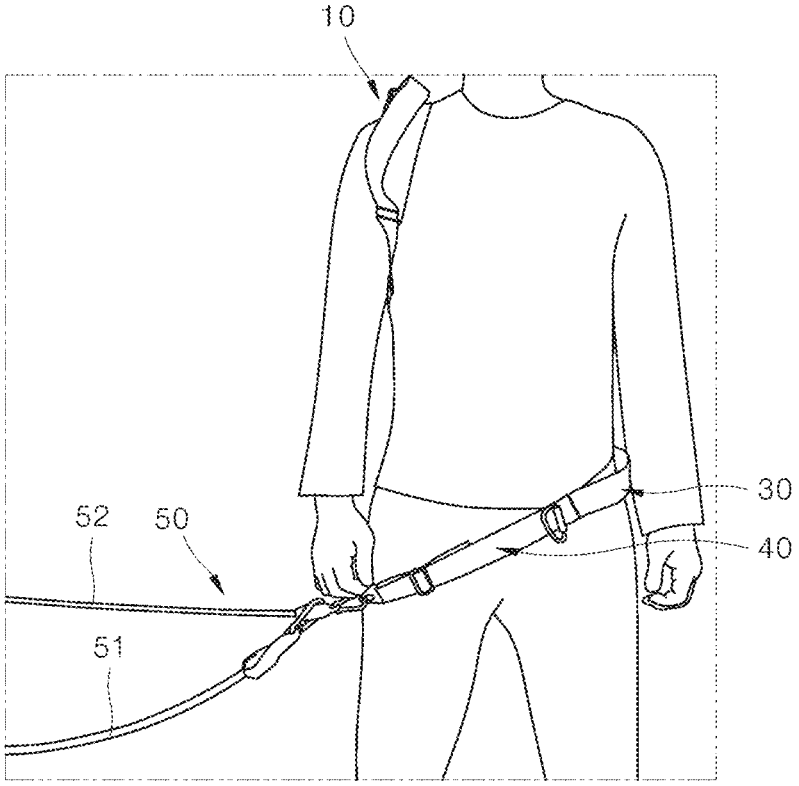

【FIG. 26】
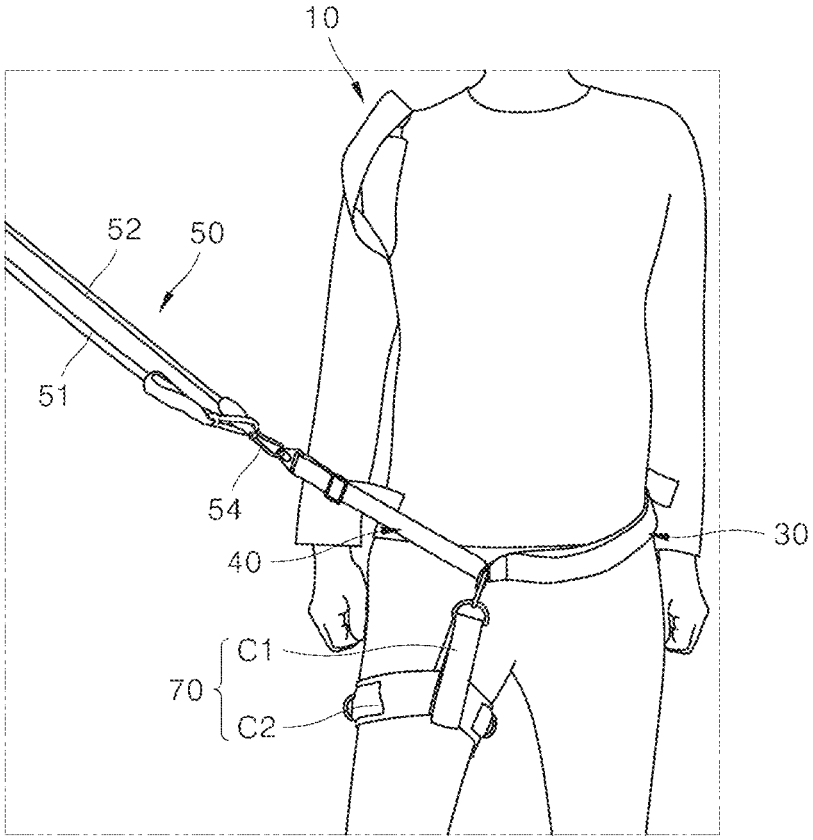

【FIG. 27】
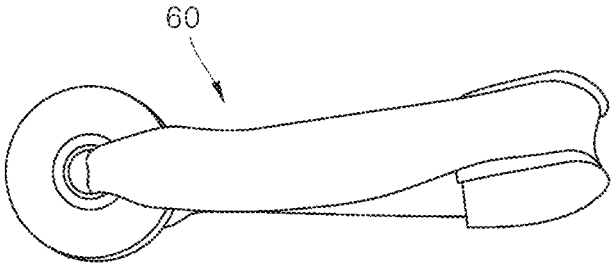
(a)
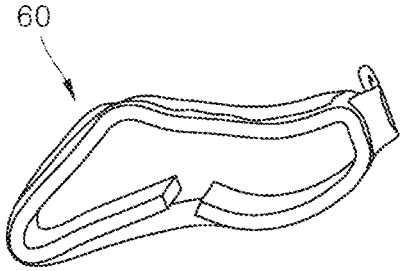
(b)
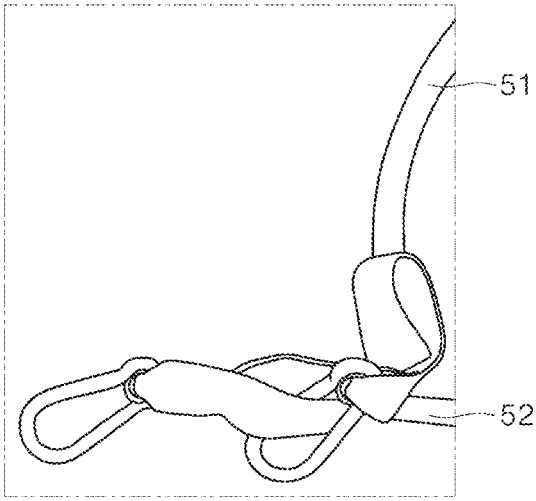
(c)

【FIG. 28】
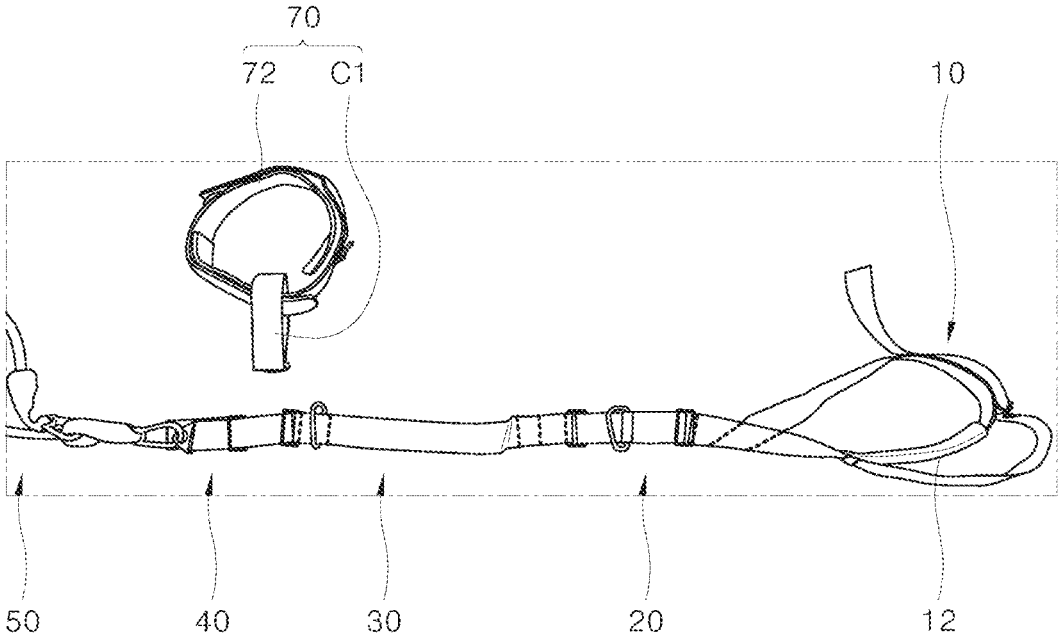

【FIG. 29】
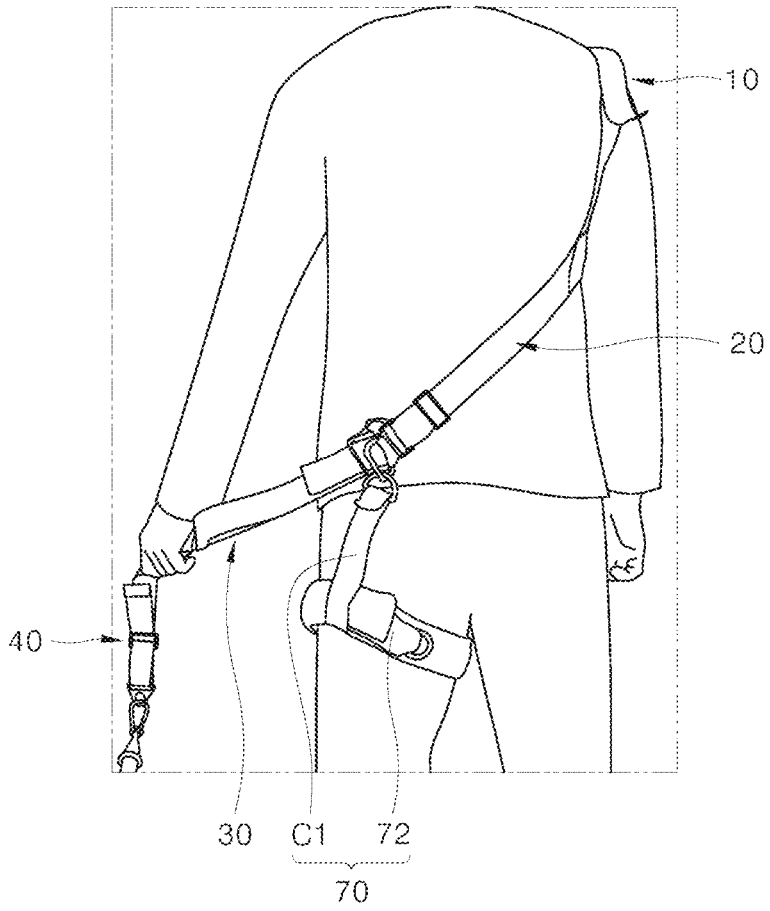

【FIG. 30】
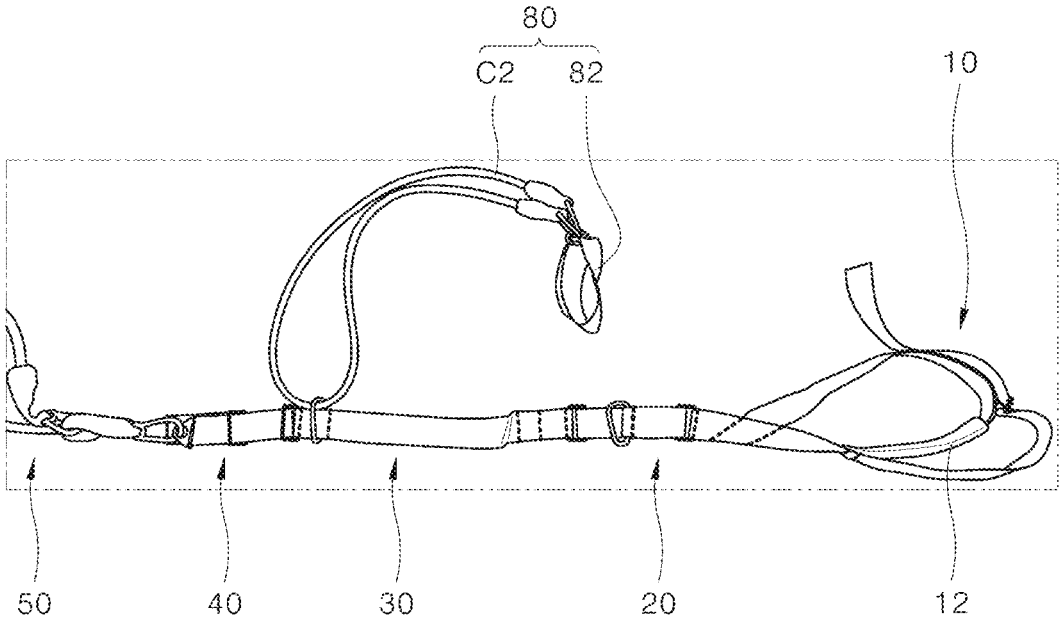
【FIG. 31】
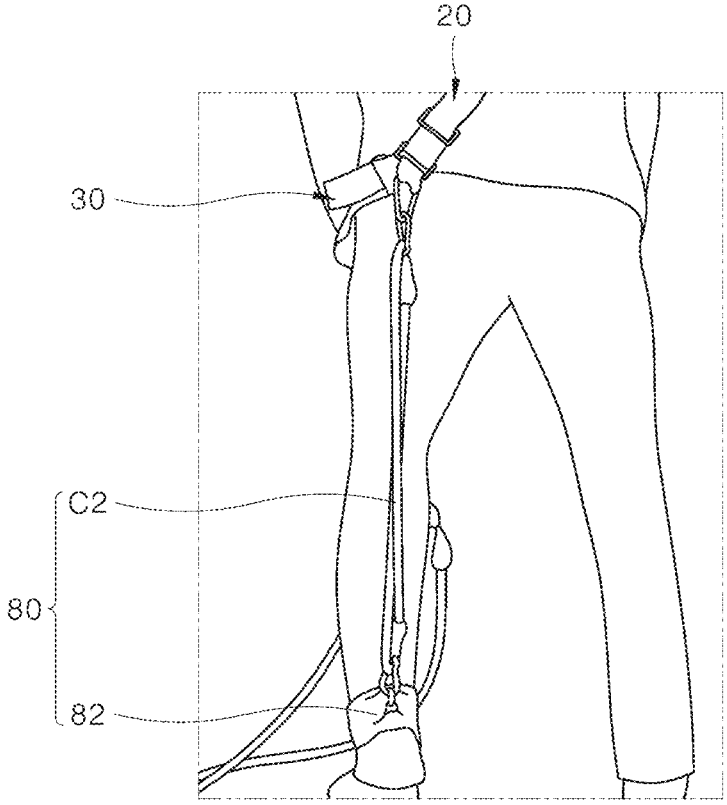

【FIG. 32】
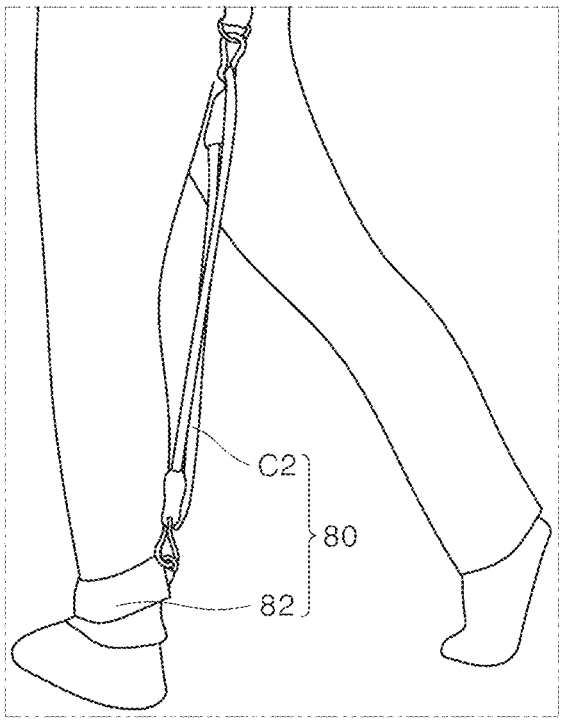

【FIG. 33】
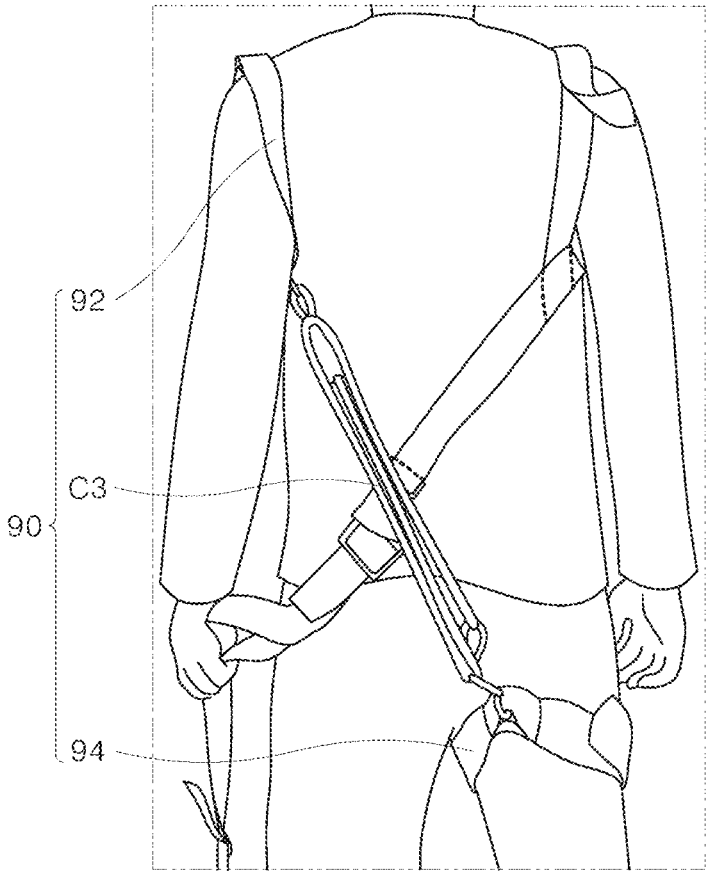

【FIG. 34】
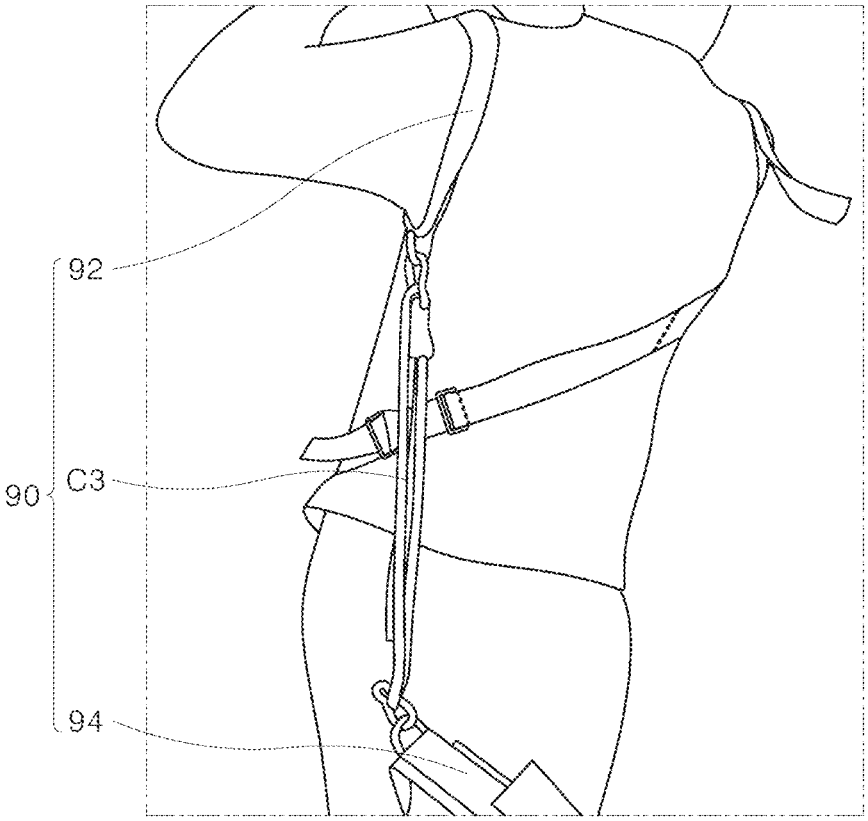

【FIG. 35】
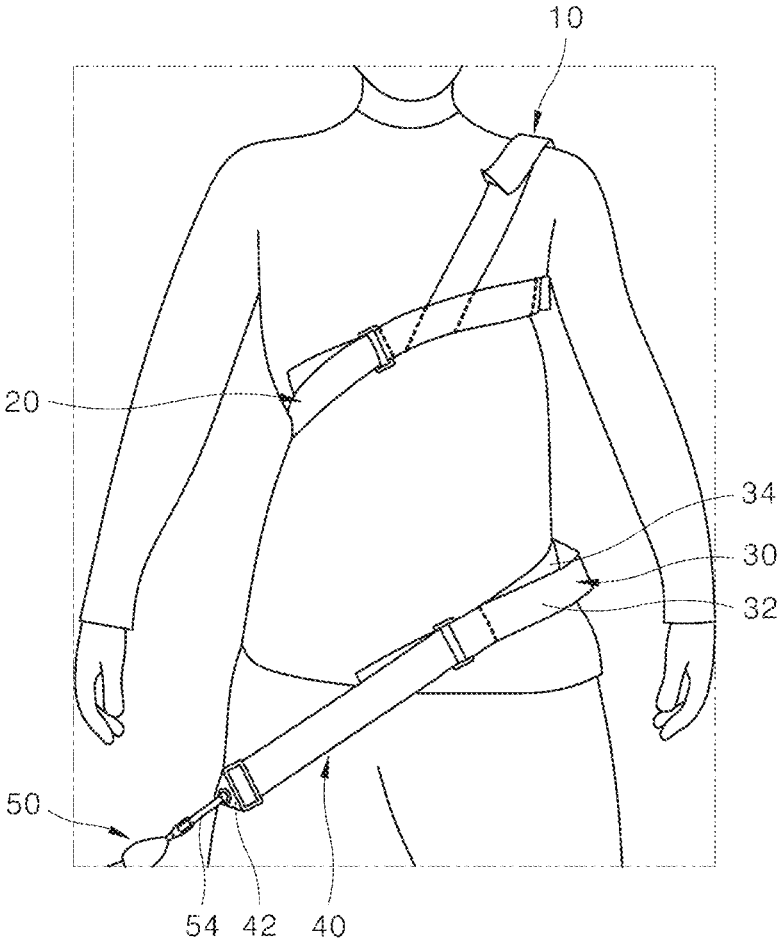

EQUIPMENT FOR STRENGTHENING SWING MOTION ABILITY

CROSS-REFERENCE TO RELATED APPLICATION

This application is a U.S. National Phase Patent Application of International Application Number PCT/KR2021/005516, filed on Apr. 30, 2021, which claims priority of Korean Patent Application Number 10-2020-0057737, filed on May 14, 2020, the entire content of each of which is incorporated herein by reference.

TECHNICAL FIELD

The present disclosure relates to equipment for strengthening swing motion ability and, particularly to equipment for strengthening swing motion ability that can increase and improve muscular strength and flexibility for swing motions when playing sports particularly golf, tennis, baseball, etc.

BACKGROUND ART

Swing is a motion that turns a portion of a body when playing sports such as golf, tennis, baseball, and hockey, and there are an underswing in golf, baseball, hockey, etc., a horizontal swing in tennis, baseball, etc., an overswing when serving a ball in tennis or throwing a ball in baseball, etc.

It is important to strengthen muscles that are used when turning a body in order to stably perform such swing motions.

Accordingly, machines for strengthening muscles that are used for swing motions have been continuously developed in the related art.

FIG. 1 is a view showing equipment for strengthening swing motion ability of the related art, FIG. 2 is a view showing the state when a user wears the equipment for strengthening swing motion ability of FIG. 1 and performs a tennis swing motion, and FIGS. 3 and 4 are views showing a user wears the equipment for strengthening swing motion ability of FIG. 1 and performs a golf swing motion.

The equipment for strengthening swing motion ability of the related art is, as shown in FIG. 1, composed of a shoulder holder 1 formed in a closed loop shape like a torus, a body holder 2 extending a predetermined length from the shoulder holder 1 to be held on a body, and an elastic rope 3 having a first end connected to the body holder 2 and a second end configured to be fixed at a predetermined position.

How to wear the equipment for strengthening swing motion ability of the related art is described. A user puts the shoulder holder 1 around the right shoulder or the left shoulder, winds the body holder 2 around the back toward the shoulder opposite to the shoulder with the shoulder holder 1 thereon such that the body holder 2 goes to the rear of the shoulder with the shoulder holder 1 thereon across the stomach.

In this state, the user practices a tennis swing as shown in FIG. 2 or a golf swing as shown in FIGS. 3 and 4.

However, the equipment for strengthening swing motion ability of the related art is focused on correcting the posture of the upper body including the shoulders and the stomach and increasing muscular strength, so it has limitation in improving balanced postures and muscular strength of the upper body and the lower body that are required to perform swing motions of tennis, golf, baseball, etc.

Further, since the shoulder holder 1 and the body holder 2 are made of nylon-reinforced bands not to easily break in the equipment for strengthening swing motion ability of the related art, there is a problem that when a user repeats a swing motion, the shoulder holder 1 and the body holder 2 presses the shoulder and the body, thereby causing pain.

Further, according to the equipment for strengthening swing motion ability of the related art, while a user repeats a swing motion, the body holder 2 held on the body keeps moving, so there is a problem that a user has to adjust the body holder 2 every time he/she swings and there is a problem that the equipment is not suitable for various swings such as an underswing, a horizontal swing, and an overswing.

DOCUMENTS OF RELATED ART

Non-Patent Document (Non-Patent Document 1) Internet site:

(Non-Patent Document 2) https://m.smartstore.naver-.com/appletreemarket/products/4867611358?NaPm=ct % 3Dk9 3mm8wo % 7Cci %3De0480b4bf152a64df5d344b809cb3c66db69acc7 %7Ctr %3Dslct %7 Csn % 3D1132820%7Chk %3D01b32c88592b36b850826679f0944f2dee4a86e5

DISCLOSURE

Technical Problem

An objective of the present disclosure is to provide equipment for strengthening swing motion ability that can improve both muscular strength and flexibility of an upper body and a lower body that are required for swing motions when playing sports particularly golf, tennis, baseball, etc.

Another objective of the present disclosure is to provide equipment for strengthening swing motion ability that makes it possible to accurately correct movement of joints without pressing a body even though a user repeats a swing motion and that enables a user to feel a comfort fit.

Another objective of the present disclosure is to provide equipment for strengthening swing motion ability that enables various swing motions such as an underswing, a horizontal swing, an overswing, etc.

Technical Solution

In order to achieve the objective of the present disclosure, equipment for strengthening swing motion ability includes: a shoulder holder formed in a closed loop shape to be held on a right shoulder or a left shoulder; a body holder extending a predetermined length from the shoulder holder to be held on a back toward a shoulder opposite to the shoulder with the shoulder holder held thereon; a pelvis holder extending a predetermined length from the body holder to be held on a pelvis positioned opposite to the shoulder with the shoulder holder held thereon; an extension extending a predetermined length from the pelvis holder toward the shoulder with the shoulder holder held thereon; and an elasticity applier having a first end connected to the extension and a second end configured to be fixed to a predetermined position.

In this configuration, the shoulder holder includes: a first outer band made of a non-elastic material and forming a closed loop; and a first inner band made of an elastic member having a predetermined length and fixed at both ends thereof around an inner circumference of the first outer band such that a center is positioned on a shoulder.

Further, the first inner band includes a plurality of inner bands and the plurality of first inner bands overlap each other inside the first outer band, and the more the first inner bands are disposed inside from the first outer band, the shorter and the more extendable the materials thereof are.

Further, a magnet and a metal are circumferentially installed with a predetermined distance therebetween on the first outer band, the magnet and the metal are attracted and attached to each other by magnetism when a pulling force is not applied in both circumferential directions of the first outer band, and the magnet and the metal are separated when a pulling force is applied in both circumferential directions of the first outer band, whereby a user can sense that a force is applied to a shoulder.

Further, the body holder has a first end coupled to the shoulder holder such that a length can be adjusted, and a second end coupled to the pelvis holder to be described below such that a length can be adjusted.

Further, the pelvis holder includes: a second outer band made of a non-elastic material; and a second inner band made of an elastic material having a predetermined length and having both ends thereof fixed to both inner ends of the second outer band such that a center is positioned on a pelvis.

In this configuration, the second inner band includes a plurality of inner bands and the plurality of the second inner bands overlap each other inside the second outer band, and the more the second inner bands are disposed inside from the second outer band, the shorter and the more extendable the materials thereof are.

Further, a magnet and a metal are longitudinally installed with a predetermined distance therebetween on the second outer band, the magnet and the metal are attracted and attached to each other by magnetism when a pulling force is not applied in both longitudinal directions of the second outer band, and the magnet and the metal are separated when a pulling force is applied in both longitudinal directions of the first outer band, whereby a user can sense that a force is applied to a pelvis.

Further, one end of the extension is coupled to an opposite side of a portion where the body holder is coupled to the pelvis holder such that a length can be adjusted, and a fastener to which the elasticity applier is fastened is formed at the other end of the extension.

The elasticity applier includes: an elastic rope made of an elastic material; and a fastening ring for fastening the elastic rope to the extension with the elastic rope fitted therein.

In this configuration, it is preferable that the elastic rope includes a plurality of elastic ropes with different lengths, and a shorter elastic rope of the plurality of elastic ropes is made of a material that extends more than a longer elastic rope.

Meanwhile, the equipment for strengthening swing motion ability may further include an elasticity applier fixer coupled to the second end of the elasticity applier to fix the elasticity applier at a predetermined position.

The elasticity applier fixer includes: a fixing body having a fitting hole; and a fixing belt fitted in the fitting hole and connected to the elasticity applier.

As another configuration, the elasticity applier fixer may include: a fixing band formed in a band shape such that both ends thereof can be detachably coupled together; and a fixing portion formed at the fixing band and connected to the elasticity applier.

Further, the equipment for strengthening swing motion ability may further include a pelvis holder retainer maintaining the pelvis holder at its position on a pelvis without moving, in which the pelvis holder retainer may include: a thigh wearing part formed in a band shape with both ends thereof that can be detachably coupled together, and configured to be worn on a thigh at a pelvis side on which the pelvis holder is held; and a first connector having a first end connected to the thigh wearing part and a second end configured to be connected to the body holder or the pelvis holder behind the body of a user.

Further, the equipment for strengthening swing motion ability further includes a leg athletic ability strengthener for increasing muscular strength and flexibility of leg muscles of a user, in which the leg athletic ability strengthener includes: an ankle wearing part formed in a band shape with both ends thereof that can be detachably coupled together, and configured to be worn on an ankle at a pelvis side on which the pelvis holder is held; and an elastic second connector having a first end connected to the ankle wearing part and a second end configured to be connected to the body holder or the pelvis holder behind the body of a user, a length of the second connector is smaller than a length from the ankle wearing part to the body holder or the pelvis holder, when a user bends and then stretches his/her knees, muscular strength of a leg of the user is increased in a process in which the second connector extends, and when the second connector no longer extends, an exercise of strengthening flexibility of a leg of a user is performed.

Further, the equipment for strengthening swing motion ability further includes a shoulder athletic ability strengthener for increasing muscular strength and flexibility of shoulder muscles of a user, in which the shoulder athletic ability strengthener includes: a shoulder wearing part formed in a band shape with both ends thereof that can be detachably coupled together and configured to be worn on a shoulder opposite to the shoulder with the shoulder holder held thereon; a thigh wearing part formed in a band shape with both ends thereof that can be detachably coupled together and configured to be worn on a thigh at a shoulder opposite to the shoulder with the shoulder holder held thereon; and an elastic third connector connecting the shoulder wearing part and the thigh wearing part behind a user's body, a length of the third connector is smaller than a length from the shoulder wearing part to the thigh wearing part, when a user turns his/her upper body, muscular strength of a shoulder of the user is increased in a process in which the third connector extends, and when the third connector no longer extends, an exercise of strengthening flexibility of a shoulder of a user is performed.

Meanwhile, equipment for strengthening swing motion ability of the present disclosure may include: a shoulder holder formed in a closed loop shape to be held on a right shoulder or a left shoulder; a body holder extending a predetermined length from the shoulder holder and configured to be wound around a back from a chest toward a shoulder opposite to the shoulder with the shoulder holder held thereon; a pelvis holder extending a predetermined length from the body holder to be held on a pelvis positioned opposite to the shoulder with the shoulder holder held thereon; an extension extending a predetermined length from the pelvis holder toward a shoulder opposite to the shoulder with the shoulder holder held thereon; and an elasticity applier having a first end connected to the extension and a second end configured to be fixed to a predetermined position.

Details of other embodiments are included in detailed description of the invention" and the accompanying "drawings".

The advantages and/or features of the present disclosure, and methods of achieving them will be clear by referring to the exemplary embodiments that will be describe hereafter in detail with reference to the accompanying drawings.

However, it should be noted that the present disclosure is not limited to the configuration of each of embodiments to be described hereafter and may be implemented in various ways, and the exemplary embodiments described in the specification are provided to complete the description of the present disclosure and let those skilled in the art completely know the scope of the present disclosure and the present disclosure is defined by claims.

Advantageous Effects

According to the present disclosure, since the shoulder holder, the body holder, the pelvis holder, the extension, and the elasticity applier are organically coupled, it is possible to increase and improve both the muscular strength and flexibility of an upper body and a lower body that are required for a swing exercise when playing sports such as gold, tennis, and baseball.

Further, according to the present disclosure, since a Limited Stretch System (LSS) is employed for the shoulder holder and the pelvis holder, it has an advantage that it is possible accurately correct movement of joints without pressing a body even though a user repeats a swing motion and it is possible to enable a user to feel a comfort fit.

Further, according to the present disclosure, since the elasticity applier fixer and the pelvis holder retainer are provided, if necessary, it is possible to perform various swing motions such as an underswing, a horizontal swing, and an over swing.

Further, according to the present disclosure, since the leg athletic ability strengthener is provided, it is possible to increase muscular strength and flexibility of a lower body for a swing motion.

Further, according to the present disclosure, since the shoulder athletic ability strengthener is provided, it is possible to increase muscular strength and flexibility of a shoulder for a swing motion.

DESCRIPTION OF DRAWINGS

FIG. 1 is a view showing equipment for strengthening swing motion ability of the related art.

FIG. 2 is a view showing the state when a user wears the equipment for strengthening swing motion ability of FIG. 1 and performs a tennis swing motion.

FIGS. 3 and 4 are views showing a user wears the equipment for strengthening swing motion ability of FIG. 1 and performs a golf swing motion.

FIG. 5 is a view showing equipment for strengthening swing motion ability according to the present disclosure.

FIG. 6 is an exploded view showing a shoulder holder, a body holder, a pelvis holder, and an extension of the equipment for strengthening swing motion ability according to the present disclosure.

FIG. 7 is a view showing the shoulder holder of the equipment for strengthening swing motion ability according to the present disclosure.

FIG. 8 is a view showing the body holder of the equipment for strengthening swing motion ability according to the present disclosure.

FIG. 9 is a view showing the pelvis holder of the equipment for strengthening swing motion ability according to the present disclosure.

FIG. 10 is a view showing the extension of the equipment for strengthening swing motion ability according to the present disclosure.

FIG. 11 is a view showing an elasticity applier of the equipment for strengthening swing motion ability according to the present disclosure.

FIGS. 12 to 14 are views illustrating a Limited Stretch System (LSS) employed for the shoulder holder and the pelvis holder of the equipment for strengthening swing motion ability according to the present disclosure, that is, FIG. 12 is a view showing the state when a non-elastic outer band and two elastic inner bands are installed, FIG. 13 is a view showing the state when an inner hand that is the most extendable is extended when two-directional pulling forces are applied, and FIG. 14 is a view showing the state when the outer band is straightened and the two elastic inner bands are all extended when two-directional pulling forces are further applied.

FIG. 15 (*a*) is a view schematically showing the state when a magnet and a metal are installed on the outer band of the shoulder holder and the pelvis holder of the equipment for strengthening swing motion ability according to the present disclosure, FIG. 15 (*b*) is a view schematically showing the state when the magnet and the metal are attracted and attached to each other by magnetism when two-directional pulling forces are not applied to the outer band, and FIG. 15 (*c*) is a view schematically showing the state in which the magnet and the metal are separated when two-directional pulling forces are applied to the outer band.

FIGS. 16 to 18 are views showing states when a user puts on the equipment for strengthening swing motion ability according to the present disclosure, that is, FIG. 16 is a view showing the state when a user puts the shoulder holder on a shoulder, FIG. 17 is a view showing the state when the user has wound the body holder back around a body, and FIG. 18 is a view showing the state when the user has put the pelvis holder on a pelvis.

FIGS. 19 to 23 are views showing that a user performs motions for a golf swing while wearing the equipment for strengthening swing motion ability according to the present disclosure, that is, FIG. 19 is a view showing a basic posture of a swing, FIG. 20 is a view showing a backswing motion, FIG. 21 is a view showing the state when weight moves during a swing, FIG. 22 is a view showing the state when a lower body turns in a swing motion, and FIG. 23 is a view showing the state when an upper body turns in a swing motion.

FIGS. 24 to 26 are views showing the state when the elasticity applier is fixed at various positions in the equipment for strengthening swing motion ability according to the present disclosure, that is, FIG. 24 is a view when the elasticity applier is fixed at a low position with respect to a user, FIG. 25 is a view when the elasticity applier fixed at the height of a pelvis, and FIG. 26 is a view when the elasticity applier is fixed at a high position with respect to a user.

FIG. 27 is a view showing an elasticity applier fixer that is employed in the equipment for strengthening swing motion ability according to the present disclosure, in which (a) shows a fixer for fixing to a door, (b) shows a fixer for fixing to a rod, a leg of a table, or the like, and (c) shows the elasticity applier that is fixed to the fixer.

FIG. 28 is a view showing a pelvis holder retainer that is employed in the equipment for strengthening swing motion ability according to the present disclosure.

FIG. 29 is a view showing the state in which the pelvis holder retainer of FIG. 28 is worn.

FIG. 30 is a view showing a leg athletic ability strengthener that is employed in the equipment for strengthening swing motion ability according to the present disclosure.

FIGS. 31 and 32 are views showing the state in which the leg athletic ability strengthener of FIG. 30 is worn.

FIGS. 33 and 34 are views showing the state in which a shoulder athletic ability strengthener that is employed in the equipment for strengthening swing motion ability according to the present disclosure is worn.

FIG. 35 is a view showing another example of wearing the equipment for strengthening swing motion ability according to the present disclosure.

MODE FOR DISCLOSURE

Hereafter, preferred embodiments of the present disclosure are described in detail with reference to the accompanying drawings.

Before describing the present disclosure in detail, terms or words used herein should not be construed as being limited to common or dictionary meanings, the concepts of various terms may be appropriately defined to the most optimally describe the invention by the inventor(s), and it should be noted that those terms or words should be construed as meanings and concepts corresponding to the technical spirit of the present disclosure.

That is, it should be noted that the terms used herein are used only to describing preferred embodiments of the present disclosure, not intending to limit the present disclosure in detail, and those terms are terms defined in consideration of various possibilities of the present disclosure.

Further, it should be noted that, in the specification, singular expression may include plural expression unless clearly stated in the sentences, and includes a singular meaning even if it is similarly expressed as a plural number.

It should be noted that when a component is described as "including" another component throughout the specification, the component may further include another component without another component excluded, unless specifically stated otherwise.

Further, it should be noted that when a component is described as "exists in" and "is connected to" another component, the component may be directly connected with another component, may be installed in contact with another component, or may be installed with a predetermined gap. When the component is installed with a gap, there may be a third component or means for fixing and connecting the component to another component, and the third component or means may not be described.

On the other hands, it should be understood that when a component is described as "directly connected" or "indirectly connected" to another component, it should be construed as there is no third component or means.

Similarly, the terms used herein to describe a relationship between elements, that is, "between", "directly between", "adjacent" or "directly adjacent" should be interpreted in the same manner as those described above.

Further, in the specification, it should be noted that terms such as "first side", "second side", "first", and "second", if used, are used to clearly discriminate one components from another component and the meaning of the corresponding component is not limited by the terms.

Further, terms related to positions such as "up", "down", "left", and "right", if used herein, should be construed as indicating relative positions of corresponding components in the corresponding figures and should not be construed as stating absolute positions unless the absolute positions of them are specified.

Further, it should be noted that, in the specification, terms such as "~part", "~er", "module", and "device", if used, mean a unit that can perform one or more functions or operations and may be implemented by hardware, software, or a combination of hardware and software.

Further, in the specification, when components are given reference numerals, the same reference numerals are given to same components even if they are shown in different figures, that is, same reference numerals indicate same components throughout the specification.

The size, position, coupling relationship, etc. of components of the present disclosure may be partially exaggerated or reduced in the accompanying drawings for the convenience of description in order to sufficiently and clearly transmit the spirit of the present disclosure, so the proportion or scale may not be precise.

Further, in the following description of the present disclosure, components that are determined to unclearly make the spirit of the present disclosure unclear, for example, well-known technology including the related art may not be described in detail.

FIG. 5 is a view showing equipment for strengthening swing motion ability according to the present disclosure and FIG. 6 is an exploded view showing a shoulder holder 10, a body holder 20, a pelvis holder 30, and an extension 40 of the equipment for strengthening swing motion ability according to the present disclosure.

Equipment for strengthening swing motion ability according to the present disclosure includes a shoulder holder 10, a body holder 20, a pelvis holder 30, an extension 40, and an elasticity applier 50.

The shoulder holder 10 is a part formed in a closed loop shape (a ring shape having a predetermined width) like a torus to be held on a right shoulder or a left shoulder.

The circumference of the closed loop of the shoulder holder 10 can be adjusted in accordance with the body shapes of users and may be implemented in a belt type or a Velcro type.

The body holder 20 is a part extending a predetermined length from the shoulder holder 10 to be held on a back toward a shoulder opposite to the shoulder with the shoulder holder 10 held thereon.

As described above, the body holder 20 is provided such that the length can be adjusted in accordance with the body shapes and body sizes of users, and may be integrated with the shoulder holder 10 or may be detachably attached to the shoulder holder 10.

The pelvis holder 30 extends a predetermined length from the body holder 20 to be held on the pelvis positioned opposite to the shoulder with the shoulder holder 10 held thereon, and may be integrated with the body holder 20 or may be detachably attached to the body holder 20.

The extension 40 is a part extending a predetermined length from the pelvis holder 30 toward the shoulder with the shoulder holder 10 held thereon, and the elasticity applier 50 to be described below is connected thereto.

The extension 40 may be integrated with the pelvis holder 30 or may be detachably attached to the pelvis holder 30.

The elasticity applier 50 is a part having a first end connected to the extension and a second end configured to be fixed to a predetermined position, and helps a user to be able to elastically move weight when the user swings.

The shoulder holder 10, the body holder 20, the pelvis holder 30, the extension 40, and the elasticity adjuster 50 are individually described hereafter.

FIG. 7 is a view showing the shoulder holder 10 of the equipment for strengthening swing motion ability according to the present disclosure.

The shoulder holder 10 is a part configured to be held on a right shoulder or a left shoulder and includes: a first outer band 12 made of non-elastic fiber, synthetic resin, etc. and formed in a closed loop shape like a torus; and a first inner band 14 made of an elastic member having a predetermined length and fixed at both ends thereof around the inner circumference of the first outer band 12 such that the center is positioned on a shoulder.

The circumference of the closed loop of the first outer band 12 can be adjusted in accordance with the body shapes of users.

The first inner band 14 may include a plurality of inner bands, and in this case, the first inner bands 14 overlap each other inside the first outer band 13, and the more the first inner bands 14 are disposed inside from the first outer band 12 (closer to a shoulder), the shorter and the more extendable the materials thereof are.

Accordingly, when a user swings and a force is applied to a shoulder, the first inner bands 14 sequentially extend from the innermost band (the band in contact with the shoulder), and then when the force increases, the shoulder is stopped by the first outer band 12.

The first outer band 12 may be made of polypropylene and the first inner band 13 may be made of latex or a mixture of latex and polypropylene.

FIG. 8 is a view showing the body holder 20 of the equipment for strengthening swing motion ability according to the present disclosure.

The body holder 20 is a part extending a predetermined length from the shoulder holder 10 to be wound around a back toward the opposite shoulder of the shoulder with the shoulder holder 10 wound thereon.

The body holder 20 has a first end coupled to the shoulder holder 10 such that the length can be adjusted, and a second end coupled to the pelvis holder 20 to be described below such that the length can be adjusted.

FIG. 9 is a view showing the pelvis holder 30 of the equipment for strengthening swing motion ability according to the present disclosure.

The pelvis holder 30 extends a predetermined length from the body holder 20 to be held on the pelvis positioned opposite to the shoulder with the shoulder holder 10 held thereon, and may be integrated with the body holder 20 or may be detachably attached to the body holder 20.

The pelvis holder 30 includes: a second outer band 32 made of a non-elastic material; and a second inner band 34 made of an elastic material having a predetermined length and having both ends thereof fixed to both inner ends of the second outer band 32 such that the center is positioned on a pelvis.

The second inner band 34 may include a plurality of inner bands, and in this case, the second inner bands 34 overlap each other inside the second outer band 32, and the more the second inner bands 34 are disposed inside from the second outer band 32 (closer to a pelvis), the shorter and the more extendable the materials thereof are.

Accordingly, when a user swings and a force is applied to a pelvis, the second inner bands 34 sequentially extend from the innermost band (the band in contact with the pelvis), and then when the force increases, the pelvis is stopped by the second outer band 32.

The second outer band 32 may be made of polypropylene and the second inner band 34 may be made of latex or a mixture of latex and polypropylene.

FIG. 10 is a view showing the extension 40 of the equipment for strengthening swing motion ability according to the present disclosure.

The extension 40 is a part extending a predetermined length from the pelvis holder 30 toward the shoulder with the shoulder holder 10 held thereon, and the elasticity applier 50 to be described below is connected thereto.

The extension 40 may be integrated with the pelvis holder 30 or may be detachably attached to the pelvis holder 30.

Further, one end of the extension 40 is coupled to an opposite side of the portion where the body holder 20 is coupled to the pelvis holder 30 such that the length can be adjusted, and a fastener 42 to which the elasticity applier 50 is fastened is formed at the other end of the extension 40.

FIG. 11 is a view showing the elasticity applier 50 of the equipment for strengthening swing motion ability according to the present disclosure.

The elasticity applier 50 is a part having a first end connected to the extension and a second end configured to be fixed to a predetermined position, and helps a user to be able to elastically move weight when the user swings.

The elasticity applier 50 includes elastic ropes 51 and 52 made of an elastic material, and a fastening ring 54 for fastening the elastic ropes 51 and 52 to the extension 40 with the elastic ropes 51 and 52 fitted therein.

It is preferable in this configuration that a plurality of elastic ropes 51 and 52 is provided with different lengths and the shorter elastic rope 52 of the plurality of elastic ropes is made of a material that extends more than the longer elastic rope 51.

That is, the shorter elastic rope 52 may be made of latex or the elastic rope 51 may be made of a mixture of latex and polypropylene.

Accordingly, a user can move his/her weight to fit to the kinds of swings when swinging.

FIGS. 12 to 14 are views illustrating a Limited Stretch System (LSS) employed for the shoulder holder 10 and the pelvis holder 30 of the equipment for strengthening swing motion ability according to the present disclosure The Limited Stretch System (LSS) is as system that adjusts intensity and an exercise range in accordance with the exercise situation of a body by overlapping two bands that are different in elasticity.

In this case, elasticity is classified in detail from a non-extendable level to a high extendible level.

FIG. 12 is a view showing the state in which an outer non-elastic band B and two inner elastic bands E1 and E2 different in elasticity are installed.

The innermost elastic band E1 is shorter and extends more than the outer elastic band E2.

The outer non-elastic band B is the longest, and the outer elastic band E2 and the inner elastic band E1 are sequentially short.

FIG. 13 is a view showing the state in which the inner elastic band E that is most extendible extends when two-directional pulling forces are applied, and FIG. 14 is a view showing the state in which the outer non-elastic band B is straightened and the two inner elastic bands E1 and E2 both extend when the two-directional pulling forces are further applied.

FIG. 15 (*a*) is a view schematically showing the state in which a magnet and a metal are installed on the outer band of the shoulder holder 10 and the pelvis holder 30 of the equipment for strengthening swing motion ability according to the present disclosure, FIG. 15 (*b*) is a view schematically showing the state in which the magnet and the metal are attached to each other by magnetism when two-directional pulling forces are not applied to the outer band, and FIG. 15 (*c*) is a view schematically showing the state in which the magnet and the metal are separated when two-directional pulling forces are applied to the outer band.

A magnet M1 and a metal M2 are installed with a predetermined therebetween in the longitudinal direction of the outer non-elastic band B (FIG. 15 (*a*)), the magnet M1 and the metal M2 are attracted and attached to each other by magnetism when a pulling force is not applied in both longitudinal directions of the outer non-elastic band B (FIG. 15 (*b*)), and the magnet M1 and the metal M2 are separated when a pulling force is applied in both longitudinal directions of the outer non-elastic band B (FIG. 15 (*c*)).

When this configuration is applied to the shoulder holder 10, the magnet M1 and the metal M2 are circumferentially installed with a predetermined distance therebetween on the first outer band 12, the magnet M1 and the metal M2 are attracted and attached to each other by magnetism when a pulling force is not applied in both circumferential directions of the first outer band 12, and the magnet M1 and the metal M2 are separated when a pulling force is applied in both circumferential directions of the first outer band 12 such that a user can sense that a force is applied to a shoulder.

When this configuration is applied to the pelvis holder 30, the magnet M1 and the metal M2 are longitudinally installed with a predetermined distance therebetween on the second outer band 32, the magnet M1 and the metal M2 are attracted and attached to each other by magnetism when a pulling force is not applied in both longitudinal directions of the second outer band 32, and the magnet M1 and the metal M2 are separated when a pulling force is applied in both longitudinal directions of the second outer band 32 such that a user can sense that a force is applied to a pelvis.

FIGS. 16 to 18 are views showing states when a user puts on the equipment for strengthening swing motion ability according to the present disclosure, that is, FIG. 16 is a view showing the state when a user puts the shoulder holder 10 on a shoulder, FIG. 17 is a view showing the state when the user has wound the body holder 20 back around a body, and FIG. 18 is a view showing the state when the user has put the pelvis holder 30 on a pelvis.

How to put on the equipment for strengthening swing motion ability according to the present disclosure is described. A user first puts the shoulder holder 10 on a right shoulder or a left shoulder and then winds the body holder 10 around the back toward the shoulder opposite to the shoulder with the shoulder holder 10 thereon.

Thereafter, a user puts the pelvis holder 30 on the pelvis positioned opposite to the shoulder with the shoulder holder 10 thereon.

FIGS. 19 to 23 are views showing that a user performs motions for a golf swing while wearing the equipment for strengthening swing motion ability according to the present disclosure.

FIG. 19 is a view showing a basic posture of a swing FIG. 20 is a view showing a backswing motion.

Tension of the elasticity applier 50 decreases in a backswing, so a backswing becomes easy.

FIG. 21 is a view showing the state when weight moves during a swing.

In a downswing, tension is applied to the elasticity applier 50 so that weight can be moved.

FIG. 22 is a view showing the state when a lower body turns in a swing motion.

When a swing motion is performed, tension of the elasticity applier 50 is too large after weight is moved, so the pelvis holder 30 (the second elastic inner band 34 and the second non-elastic outer band 32) has to be used. Accordingly, the pelvis should be turned for a smooth swing.

FIG. 23 is a view showing the state when an upper body turns in a swing motion.

In a follow throw, the pelvis holder 30 also no longer extend, so it is necessarily required to use the shoulder holder 10 (the first elastic inner band 14 and the first non-elastic outer band 12) by turning a shoulder.

As described above, since the equipment for strengthening swing motion ability according to the present disclosure employs a Limited Stretch System (LSS) for the shoulder holder 10 and the pelvis holder 30, it has an advantage that it is possible accurately correct movement of joints without pressing a body even though a user repeats a swing motion and it is possible to enable a user to feel a comfort fit.

FIGS. 24 to 26 are views showing the state when the elasticity applier 50 is fixed at various positions in the equipment for strengthening swing motion ability according to the present disclosure, that is, FIG. 24 is a view when the elasticity applier 50 is fixed at a low position with respect to a user, FIG. 25 is a view when the elasticity applier 50 fixed at the height of a pelvis, and FIG. 26 is a view when the elasticity applier 50 is fixed at a high position with respect to a user.

When the elasticity applier 50 is fixed at a low position with respect to a user, as shown in FIG. 24, the user can practice an underswing motion of golf, hockey, baseball, etc.

When the elasticity applier 50 is fixed at the height of a pelvis of a user, as shown in FIG. 25, the user can practice a horizontal swing motion of tennis, baseball, etc.

When the elasticity applier 50 is fixed at a high position with respect to a user, as shown in FIG. 26, the user can practice an overswing motion when serving a ball, throwing a ball, or the like.

FIG. 27 is a view showing an elasticity applier fixer 60 that is applied to the equipment for strengthening swing motion ability according to the present disclosure, in which (a) shows a fixer for fixing to a door, (b) shows a fixer for fixing to a rod, a leg of a table, or the like, and (c) shows the elastic member that is fixed to the fixer.

An elasticity applier fixer 60 that is coupled to the second end of the elasticity applier 50 to fix the elasticity applier 50 at a high position with respect to a user or at the height of a pelvis of a user may be further included.

The elasticity applier fixer 60 is provided for fixing to a door, etc., and as shown in FIG. 27 (*a*), includes: a ring-shaped fixing body having a fitting hole at the center; and a fixing belt fitted in the fitting hole of the fixing body and connected to the elasticity applier.

For example, when a door is closed with the fixing body outside the door and the fixing belt stuck in the chink in the door, the elasticity applier fixer 60 is fixed to the door.

In this case, the elasticity applier fixer 60 can be fixed to an upper portion of the door for an overswing motion and can be fixed to a portion of the door at the height of the pelvis of the user for a horizontal swing motion.

Meanwhile, for an underswing motion in golf, hockey, baseball, etc., the elasticity applier 50 should be fixed at a low position with respect to a user such as the lower portion of a rod or a leg of a desk.

The elasticity applier fixer 60, as shown in FIG. 27 (*b*), may include: a fixing band formed in a band shape such that both ends thereof can be detachably coupled together; and a ring-shaped fixing portion formed at the fixing band and connected to the elasticity applier.

The equipment can be applied to various events of sports requiring swing motions in accordance with the height at which the elasticity applier 50 is fixed.

FIG. 28 is a view showing a pelvis holder retainer 70 that is employed in the equipment for strengthening swing motion ability according to the present disclosure and FIG. 29 is a view showing the state in which the pelvis holder retainer 70 of FIG. 28 is worn.

The equipment may further include a pelvis holder retainer 70 that can maintain the pelvis holder 30 at its position on a pelvis without moving.

The pelvis holder retainer 70 includes: a thigh wearing part 72 that is formed in a band shape with both ends thereof that can be detachably coupled together, and is configured to be worn on the thigh at a pelvis side on which the pelvis holder is held; and a first connector C1 that has a first end connected to the thigh wearing part 72 and a second end configured to be connected to the body holder 20 or the pelvis holder 30 behind the body of a user.

FIG. 30 is a view showing a leg athletic ability strengthener 80 that is employed in the equipment for strengthening swing motion ability according to the present disclosure and FIGS. 31 and 32 are views showing the state in which the leg athletic ability strengthener 80 of FIG. 30 is worn.

The equipment for strengthening swing motion ability according to the present disclosure may further include a leg athletic ability strengthener 80 for increasing muscular strength and flexibility of the leg muscles of a user.

The leg athletic ability strengthener 80 includes: an ankle wearing part 82 that is formed in a band shape with both ends thereof that can be detachably coupled together, and is configured to be worn on the ankle at a pelvis side on which the pelvis holder is held; and an elastic second connector C2 that has a first end connected to the ankle wearing part 82 and a second end configured to be connected to the body holder 20 or the pelvis holder 30 behind the body of a user.

The length of the second connector C2 is smaller than the length from the ankle wearing part 82 to the body holder 20 or the pelvis holder 30; when a user bends and then stretches his/her knees, the muscular strength of a leg of the user is increased in the process in which the second connector C2 extends; and when the second connector C2 no longer extends, an exercise of strengthening flexibility of a leg of a user is performed.

FIGS. 33 and 34 are views showing the state in which a shoulder athletic ability strengthener 90 that is employed in the equipment for strengthening swing motion ability according to the present disclosure is worn.

The equipment for strengthening swing motion ability according to the present disclosure may further include a shoulder athletic ability strengthener 90 for increasing muscular strength and flexibility of the shoulder muscles of a user.

The shoulder athletic ability strengthener 90 includes: a shoulder wearing part 92 that is formed in a band shape with both ends thereof that can be detachably coupled together and is configured to be worn on a shoulder opposite to the shoulder with the shoulder holder 10 held thereon; a thigh wearing part 94 that is formed in a band shape with both ends thereof that can be detachably coupled together and is configured to be worn on the thigh at a shoulder opposite to the shoulder with the shoulder holder 10 held thereon; and an elastic third connector C3 connecting the shoulder wearing part 92 and the thigh wearing part 94 behind the user's body.

The length of the third connector C3 is smaller than the length from the shoulder wearing part 92 to the thigh wearing part 94; when a user turns his/her upper body, the muscular strength of a shoulder of the user is increased in the process in which the third connector C3 extends; and when the third connector C3 no longer extends, an exercise of strengthening flexibility of a shoulder of a user.

As described above, according to the equipment for strengthening swing motion ability according to the present disclosure, since the shoulder holder 10, the body holder 20, the pelvis holder 30, the extension 40, and the elasticity applier 50 are organically coupled, and additionally, the elasticity applier fixer 60, the pelvis holder retainer 70, the leg athletic ability strengthener 80, and the shoulder athletic ability strengthener 90 are provided, there is an advantage that it is possible to increase and improve both the muscular strength and flexibility of an upper body and a lower body that are required for a swing exercise when playing sports such as gold, tennis, and baseball.

FIG. 35 is a view showing another example of wearing the equipment for strengthening swing motion ability according to the present disclosure.

The equipment for strengthening swing motion ability according to the present disclosure may include: a shoulder holder 10 that is formed in a closed loop shape to be held on a right shoulder or a left shoulder; a body holder 20 that extends a predetermined length from the shoulder holder 10 and is configured to be wound around a back from a chest toward a shoulder opposite to the shoulder with the shoulder holder 10 held thereon; a pelvis holder 30 that extends a predetermined length from the body holder 20 to be held on the pelvis at the shoulder with the shoulder holder 10 held thereon; an extension 40 that extends a predetermined length from the pelvis holder 30 toward a shoulder opposite to the shoulder with the shoulder holder 10 held thereon; and an elasticity applier 50 that has a first end connected to the extension 40 and a second end configured to be fixed at a predetermined position.

That is, according to FIGS. 19 to 23 described above, a right-handed user is supposed to put the shoulder holder on his/her right shoulder. However, as shown in FIG. 35, a right-handed user may use the equipment by putting the shoulder holder 10 on his/her left shoulder, extending and winding the body holder 20 around his/her back, and putting the pelvis holder 30 on the left pelvis at the left shoulder with the shoulder holder 10 held thereon.

As described above, the equipment for strengthening swing motion ability according to the present disclosure has the advantage that it is possible to increase and improve the muscular strength and flexibility of the left and right sides of a body only by changing the wearing way.

Various preferred embodiments of the present disclosure were described above through some examples, but the various embodiments described in "detailed description of the invention" are only examples and it would be clearly understood by those skilled in the art the present disclosure may be changed in various ways or equivalently implemented from the above description.

Further, it should be noted that since the present disclosure may be implemented in other various ways, the present disclosure is not limited to the above description, the above description is provided to completely explain the present disclosure and provided only to completely inform those skilled in the art of the range of the present disclosure, and the present disclosure is defined by only claims.

EXPLANATION OF REFERENCE NUMERALS

10 shoulder holder
20 body holder

30 pelvis holder
40 extension
50 elasticity applier
60 elasticity applier fixer
70 pelvis holder retainer
80 leg athletic ability strengthener
90 shoulder athletic ability strengthener

The invention claimed is:

1. Equipment for strengthening swing motion ability comprising:

a shoulder holder formed in a closed loop shape to be held on a right shoulder or a left shoulder;

a body holder extending a predetermined length from the shoulder holder to be held on a back toward a shoulder opposite to the shoulder with the shoulder holder held thereon;

a pelvis holder extending a predetermined length from the body holder to be held on a pelvis positioned opposite to the shoulder with the shoulder holder held thereon;

an extension extending a predetermined length from the pelvis holder toward the shoulder with the shoulder holder held thereon; and an elasticity applier having a first end connected to the extension and a second end configured to be fixed to a predetermined position so that a user can elastically move weight when swinging, wherein the pelvis holder includes:

a second outer band made of a non-elastic material; and a second inner band made of an elastic material having a predetermined length and having both ends thereof fixed to both inner ends of the second outer band such that a center is positionable on a pelvis.

2. The equipment for strengthening swing motion ability of claim 1, wherein the shoulder holder includes:

a first outer band made of a non-elastic material and forming a closed loop; and a first inner band made of an elastic member having a predetermined length and fixed at both ends thereof around an inner circumference of the first outer band such that a center is positioned on a shoulder.

3. The equipment for strengthening swing motion ability of claim 2, wherein the first inner band includes a plurality of inner bands and the plurality of first inner bands overlap each other inside the first outer band, and the more the first inner bands are disposed inside from the first outer band, the shorter and the more extendable the materials thereof are.

4. The equipment for strengthening swing motion ability of claim 3, wherein a magnet and a metal are circumferentially installed with a predetermined distance therebetween on the first outer band, the magnet and the metal are attracted and attached to each other by magnetism when a pulling force is not applied in both circumferential directions of the first outer band, and the magnet and the metal are separated when a pulling force is applied in both circumferential directions of the first outer band, whereby a user can sense that a force is applied to a shoulder.

5. The equipment for strengthening swing motion ability of claim 1, wherein the body holder has a first end coupled to the shoulder holder such that a length can be adjusted, and a second end coupled to the pelvis holder such that a length can be adjusted.

6. The equipment for strengthening swing motion ability of claim 1, wherein the second inner band includes a plurality of inner bands and the plurality of the second inner bands overlap each other inside the second outer band, and the more the second inner bands are disposed inside from the second outer band, the shorter and the more extendable the materials thereof are.

7. The equipment for strengthening swing motion ability of claim 6, wherein a magnet and a metal are longitudinally installed with a predetermined distance therebetween on the second outer band, the magnet and the metal are attracted and attached to each other by magnetism when a pulling force is not applied in both longitudinal directions of the second outer band, and the magnet and the metal are separated when a pulling force is applied in both longitudinal directions of the first outer band, whereby a user can sense that a force is applied to a pelvis.

8. The equipment for strengthening swing motion ability of claim 1, wherein one end of the extension is coupled to an opposite side of a portion where the body holder is coupled to the pelvis holder such that a length can be adjusted, and a fastener to which the elasticity applier is fastened is formed at the other end of the extension.

9. The equipment for strengthening swing motion ability of claim 1, wherein the elasticity applier includes:

an elastic rope made of an elastic material; and a fastening ring for fastening the elastic rope to the extension with the elastic rope fitted therein.

10. The equipment for strengthening swing motion ability of claim 9, wherein the elastic rope includes a plurality of elastic ropes with different lengths, and a shorter elastic rope of the plurality of elastic ropes is made of a material that extends more than a longer elastic rope.

11. The equipment for strengthening swing motion ability of claim 1, further comprising an elasticity applier fixer coupled to the second end of the elasticity applier to fix the elasticity applier at a predetermined position.

12. The equipment for strengthening swing motion ability of claim 11, wherein the elasticity applier fixer includes:

a fixing body having a fitting hole; and a fixing belt fitted in the fitting hole and connected to the elasticity applier.

13. The equipment for strengthening swing motion ability of claim 11, wherein the elasticity applier fixer includes:

a fixing band formed in a band shape such that both ends thereof can be detachably coupled together; and a fixing portion formed at the fixing band and connected to the elasticity applier.

14. The equipment for strengthening swing motion ability of claim 1, further comprising a shoulder athletic ability strengthener for increasing muscular strength and flexibility of shoulder muscles of a user, wherein the shoulder athletic ability strengthener includes:

a shoulder wearing part formed in a band shape with both ends thereof that can be detachably coupled together and configured to be worn on a shoulder opposite to the shoulder with the shoulder holder held thereon;

a thigh wearing part formed in a band shape with both ends thereof that can be detachably coupled together and configured to be worn on a thigh at a shoulder opposite to the shoulder with the shoulder holder held thereon; and an elastic third connector connecting the shoulder wearing part and the thigh wearing part behind a user's body, a length of the third connector is smaller than a length from the shoulder wearing part to the thigh wearing part.

15. Equipment for strengthening swing motion ability comprising a shoulder holder formed in a closed loop shape to be held on a right shoulder or a left shoulder;

a body holder extending a predetermined length from the shoulder holder and configured to be wound around a back from a chest toward a shoulder opposite to the shoulder with the shoulder holder held thereon;

a pelvis holder extending a predetermined length from the body holder to be held on a pelvis positioned opposite to the shoulder with the shoulder holder held thereon;

an extension extending a predetermined length from the pelvis holder toward a shoulder opposite to the shoulder with the shoulder holder held thereon; and an elasticity applier having a first end connected to the extension and a second end configured to be fixed to a predetermined position so that a user can elastically move weight when swinging, wherein the pelvis holder includes:

a second outer band made of a non-elastic material; and a second inner band made of an elastic material having a predetermined length and having both ends thereof fixed to both inner ends of the second outer band such that a center is positionable on a pelvis.

* * * * *